US011279532B2

(12) United States Patent
Smith et al.

(10) Patent No.: US 11,279,532 B2
(45) Date of Patent: Mar. 22, 2022

(54) PRODUCT AND PACKAGE WITH A PHOTOSENSITIVE USE-EVIDENT FEATURE

(71) Applicant: Owens-Brockway Glass Container Inc., Perrysburg, OH (US)

(72) Inventors: Roger P. Smith, Perrysburg, OH (US); Jessica R. Bryant, Toledo, OH (US); Chris D. Anderson, Perrysburg, OH (US); Scott Cooper, Perrysburg, OH (US); Terence J. Clark, Sanford, MI (US); Oleg Feygenson, Saint Petersburg (RU); Anatoly Solunin, Saint Petersburg (RU)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 22 days.

(21) Appl. No.: 15/909,124

(22) Filed: Mar. 1, 2018

(65) Prior Publication Data

US 2018/0186526 A1 Jul. 5, 2018

Related U.S. Application Data

(60) Division of application No. 15/149,377, filed on May 9, 2016, now Pat. No. 9,938,058, which is a (Continued)

(51) Int. Cl.
*B65D 51/24* (2006.01)
*B65B 43/00* (2006.01)

(Continued)

(52) U.S. Cl.
CPC ..... *B65D 51/248* (2013.01); *B65B 43/00* (2013.01); *B65D 25/00* (2013.01); *B65D 49/00* (2013.01);

(Continued)

(58) Field of Classification Search
CPC ..... B65B 43/00; B65D 49/00; B65D 51/248; B65D 2203/12; B65D 2203/00;

(Continued)

(56) References Cited

U.S. PATENT DOCUMENTS 520,219 A 5/1894 Rand
617,782 A * 1/1899 Smith ..... B65D 55/02 215/250

(Continued)

FOREIGN PATENT DOCUMENTS

AU 2013345212 B2 5/2014
AU 2017202839 B2 5/2017

(Continued)

OTHER PUBLICATIONS

Chinese Office Action with English Translation, Serial No. 201811061020.4, Applicant: Owens-Brockway Glass Container Inc., Title: Product and Package with a Photosensitive Use-Evident Feature, dated Sep. 24, 2019.

(Continued)

*Primary Examiner* — Thomas M Wittenschlaeger

(57) ABSTRACT

A product includes a container, a photosensitive material carried by the container and responsive to ultraviolet light, and a UV protector carried by the container to protect the photosensitive material from exposure to UV light. A method of producing a food or beverage container includes applying a photochromic material to a food or beverage container that is responsive to ultraviolet (UV) light so as to darken upon exposure thereto, and protecting at least a portion of the photochromic material from exposure to UV light.

7 Claims, 15 Drawing Sheets

Related U.S. Application Data continuation of application No. 13/679,506, filed on Nov. 16, 2012, now Pat. No. 9,365,314.

(51) Int. Cl.

| | |
|---|---|
| ***B65D 25/00*** | (2006.01) |
| ***B65D 49/00*** | (2006.01) |
| ***B65D 55/02*** | (2006.01) |
| ***B65D 81/00*** | (2006.01) |

(52) U.S. Cl.

CPC ..... *B65D 55/026* (2013.01); *B65D 81/00* (2013.01); *B65D 2203/00* (2013.01); *B65D 2203/02* (2013.01); *B65D 2203/04* (2013.01); *B65D 2203/12* (2013.01); *B65D 2401/00* (2020.05)

(58) Field of Classification Search

CPC ..... B65D 2203/02; B65D 2203/04; B65D 55/026; B65D 25/00; B65D 81/00; B65D 2101/00; B65D 49/12; B65D 55/02; B65D 41/3495; B65D 51/2871; B65D 51/2885; B65D 51/245; G09F 2003/0273

USPC ..... 206/459.1

See application file for complete search history.

(56) References Cited

U.S. PATENT DOCUMENTS

| | | | | |
|---|---|---|---|---|
| 2,032,478 | A | 3/1936 | Hasse | |
| 2,099,669 | A | 11/1937 | Bangs et al. | |
| 2,143,508 | A * | 1/1939 | Collens | B65D 55/026 40/310 |
| 2,515,937 | A | 7/1950 | Stookey | |
| 2,515,936 | A | 7/1952 | William, Jr. | |
| 3,325,299 | A | 6/1967 | Araujo | |
| 3,399,811 | A | 9/1968 | Miller | |
| 4,740,401 | A | 4/1988 | Barkham et al. | |
| 4,816,305 | A | 3/1989 | Stillwell et al. | |
| 5,018,632 | A * | 5/1991 | Schmidt | B65D 55/066 215/230 |
| 5,149,578 | A * | 9/1992 | Wheatley | B32B 7/02 206/807 |
| 5,292,018 | A | 3/1994 | Travisano | |
| 5,581,090 | A | 12/1996 | Goudjil | |
| 6,254,247 | B1 | 7/2001 | Carson | |
| 6,405,867 | B1 | 6/2002 | Moore | |
| 6,929,136 | B2 * | 8/2005 | Salazar-Leal | B65D 51/245 116/207 |
| 6,964,492 | B1 | 11/2005 | Nicklowitz | |
| D520,219 | S | 5/2006 | Mazzarolo | |
| 7,040,776 | B2 * | 5/2006 | Harrell | B65D 51/248 362/101 |
| 7,258,458 | B2 * | 8/2007 | Mochiachvili | A47G 23/0309 362/101 |
| 7,335,322 | B2 | 2/2008 | Nakazawa et al. | |
| 7,547,109 | B2 * | 6/2009 | Schmidt | A63H 33/22 362/118 |
| 7,682,696 | B2 * | 3/2010 | Dean | A61L 2/07 116/206 |
| 8,212,226 | B2 * | 7/2012 | Chisholm | B65D 23/14 250/461.1 |
| 8,292,100 | B2 * | 10/2012 | Lantis | B65D 51/00 215/45 |
| 8,662,696 | B2 * | 3/2014 | Lederer | B65D 51/248 362/154 |
| 9,193,494 | B2 * | 11/2015 | Smith | B65D 1/023 |
| 9,283,526 | B2 * | 3/2016 | Smith | B01F 3/04794 |
| 9,365,314 | B2 * | 6/2016 | Smith | B65B 43/00 |
| 9,367,849 | B1 * | 6/2016 | Smith | G06Q 30/0185 |
| 9,409,682 | B2 * | 8/2016 | Newsom | B65D 1/023 |
| 9,580,215 | B2 * | 2/2017 | Anderson | B65D 85/00 |
| 9,938,058 | B2 | 4/2018 | Smith et al. | |
| 9,963,269 | B2 * | 5/2018 | Bryant | B65D 25/205 |
| D824,838 | S | 8/2018 | Takamura | |
| 2002/0079692 | A1 * | 6/2002 | Pennaz | C09D 11/50 283/81 |
| 2003/0029766 | A1 * | 2/2003 | Abe | B65D 77/02 206/455 |
| 2003/0063460 | A1 | 4/2003 | Nadel | |
| 2003/0095253 | A1 * | 5/2003 | Chow | B65D 1/02 356/240.1 |
| 2003/0142267 | A1 | 7/2003 | Gemert et al. | |
| 2004/0238380 | A1 | 12/2004 | Newman | |
| 2005/0145525 | A1 * | 7/2005 | Williams | B65D 43/02 206/459.1 |
| 2005/0285050 | A1 * | 12/2005 | Bruce | G01J 1/429 250/474.1 |
| 2006/0102582 | A1 | 5/2006 | Wakefield et al. | |
| 2006/0139928 | A1 * | 6/2006 | Griffiths | B65D 51/248 362/276 |
| 2007/0201220 | A1 * | 8/2007 | Ulicny | B65D 23/00 362/101 |
| 2007/0206327 | A1 | 9/2007 | Casillas | |
| 2008/0121816 | A1 * | 5/2008 | Ellig | G01J 1/429 250/474.1 |
| 2009/0284723 | A1 | 11/2009 | Vitale | |
| 2010/0147725 | A1 | 6/2010 | Timmann et al. | |
| 2010/0163749 | A1 * | 7/2010 | Hunwick, III | G01K 11/12 250/474.1 |
| 2010/0219195 | A1 | 9/2010 | Cook et al. | |
| 2011/0100857 | A1 * | 5/2011 | Wang | B65D 81/30 206/524.1 |
| 2011/0215054 | A1 | 9/2011 | Lantis et al. | |
| 2011/0228518 | A1 | 9/2011 | Vagnby | |
| 2012/0168333 | A1 * | 7/2012 | Mackay | A45D 34/00 206/459.1 |
| 2014/0237949 | A1 * | 8/2014 | Bryant | B65D 55/02 53/471 |
| 2014/0263158 | A1 * | 9/2014 | Whitton | B65D 23/00 215/366 |
| 2018/0186526 | A1 * | 7/2018 | Smith | B65B 43/00 |

FOREIGN PATENT DOCUMENTS

| | | | |
|---|---|---|---|
| AU | 2017228651 | B2 | 10/2017 |
| CN | 2372262 | Y | 4/2000 |
| CN | 1431130 | A | 7/2003 |
| CN | 2688623 | Y | 3/2005 |
| CN | 1832887 | A | 9/2006 |
| CN | 201057578 | Y | 5/2008 |
| CN | 101291857 | A | 10/2008 |
| CN | 201753142 | U | 3/2011 |
| EP | 2920083 | B1 | 9/2015 |
| EP | 3263476 | A8 | 1/2018 |
| EP | 3444199 | A2 | 2/2019 |
| TW | 200512282 | A | 4/2005 |
| TW | 200523187 | A | 7/2005 |
| TW | I1574891 | B | 3/2017 |
| TW | I652207 | B | 3/2019 |
| WO | 2004110892 | A1 | 12/2004 |
| WO | 2007021294 | A1 | 2/2007 |
| WO | 2011135250 | A1 | 11/2011 |
| WO | 2014078128 | A1 | 5/2014 |
| WO | 2014149803 | A1 | 9/2014 |

OTHER PUBLICATIONS

Brazilian Office Action with English Translation, Serial No. BR112015010485-1, Applicant: Owens-Brockway Glass Container Inc., dated Oct. 30, 2019.

Notification for the Opinion of Examination, Owens-Brockway Glass Container Inc., dated Nov. 21, 2018, No. (107)2(2)04463-10721088810.

Modified Substantive Examination Clear Report Section 30(1)/30(2), Application No. PI 2015000775 dated Dec. 14, 2018.

Partial European Search Report, Application No. 18198336.2-1017, Applicant: Owens-Brockway Glass Container Inc., dated Jan. 15, 2019.

(56) References Cited

OTHER PUBLICATIONS

Taiwan Notification for the Opinion of Examination, Taiwanese Div. Patent Application No. 106105463, Applicant: Owens-Brockway Glass Container Inc., dated Aug. 27, 2018.
PCT International Search Report and Written Opinion, Int. Serial No. PCT/US2013/068472, Int. Filing Date: Nov. 5, 2013, Applicant: Owens-Brockway Glass Container Inc., dated Feb. 11, 2014.
English Translation of Taiwanese Office Action, Serial No. 107122977, Applicant: Owens-Brockway Glass Container Inc., dated Mar. 23, 2020.
Canadian Office Action, Canadian Application No. 2,889,324, Title: Product and Package with a Photosensitive Use-Evident Feature, Applicant: Owens-Brockway Glass Container Inc., dated Apr. 22, 2020.
Canadian Office Action, CA Application No. 2,889,324, Applicant: Owens-Brockway Glass Container Inc., dated Nov. 23, 2020.
Australian Examination Report No. 1, Australian Application No. 2019210514, Earliest Priority Date: Nov. 16, 2012, Applicant: Owens-Brockway Glass Container Inc., dated Jun. 4, 2020.

* cited by examiner

PRODUCT AND PACKAGE WITH A PHOTOSENSITIVE USE-EVIDENT FEATURE

The present disclosure is directed to containers and, more particularly, to containers having anti-counterfeit and/or tamper-evident features.

BACKGROUND AND SUMMARY OF THE DISCLOSURE

Many containers are provided with tamper-resistant devices to resist refilling of contents in the containers. For example, a beverage container can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product including a container and a use indicator carried by the container that indicates whether the container has been used and, thus, will provide evidence of efforts to repackage the container with counterfeit product.

The present disclosure embodies a number of aspects that can be implemented separately from or in combination with each other.

A product in accordance with one aspect of the disclosure includes a container, a photochromic material carried by the container and responsive to ultraviolet (UV) light so as to darken upon exposure thereto, and a UV protector over the photochromic material to protect the photochromic material from exposure to UV light.

In accordance with a further aspect of the disclosure, there is provided a method of producing a package that includes applying a photochromic material to a container that is responsive to ultraviolet (UV) light so as to darken upon exposure thereto, and protecting at least a portion of the photochromic material from exposure to UV light before initial opening of the package. The method also includes filling the container with an original flowable product, and applying a closure to the container.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
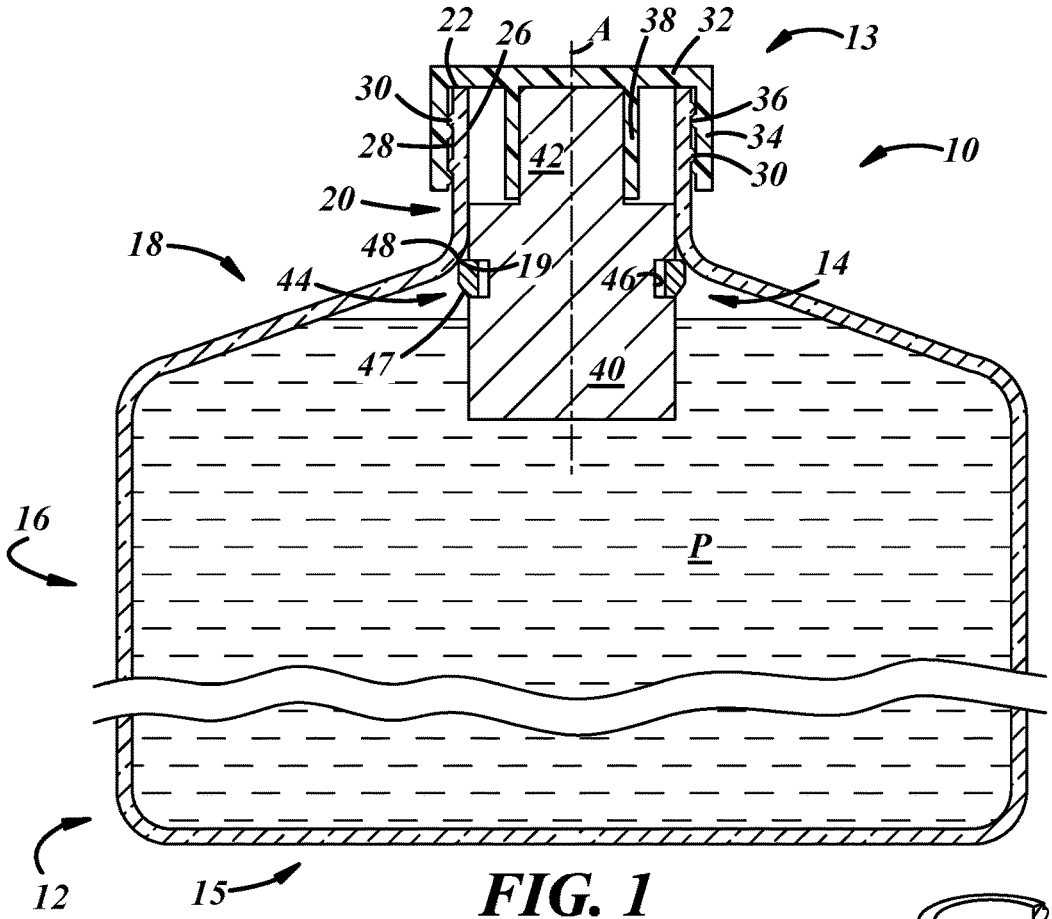
FIG. 1 is a cross-sectional elevational view of a package according to an illustrative embodiment of the present disclosure, including a container, a closure coupled to the container, and a package opening indicator coupled to the closure and positioned within the container.

FIG. 1 illustrates a package 10 in accordance with an illustrative embodiment of the disclosure. The package 10 is illustrated in its original factory sealed state or condition, as including a container 12, a closure 13 for the container 12, and an authentic, genuine, or original material or product P filling the container 12.

Additionally, the package 10 may include a package opening indicator 14 carried by the container 12. As used herein, the phrase "carried by the container" includes carried in the container, carried on the container, coupled to the container, and the like. As will be described in further detail below, the indicator 14 is a drop-style indicator that drops into the container 12 upon closure removal. As such, the indicator 14 may facilitate evidencing of efforts to tamper with the package 10, by providing visible evidence that the package 10 has been opened from its original factory sealed condition.

Also, the package 10 includes a photosensitive material and, more particularly, a photochromic material that is responsive to ultraviolet (UV) light so as to darken upon exposure thereto. The photochromic material may include a metal halide material, which may include silver, copper, and/or cadmium with chlorine, bromine, and/or iodine halides. The photochromic material may include any suitable material selected from the group(s) consisting of the aforementioned materials, or from any other suitable photochromic material(s). Photochromic materials, in and of themselves, and their application to glass, are well known to those of ordinary skill in the art, as illustrated by U.S. Pat. No. 3,325,299.

Figure 2:
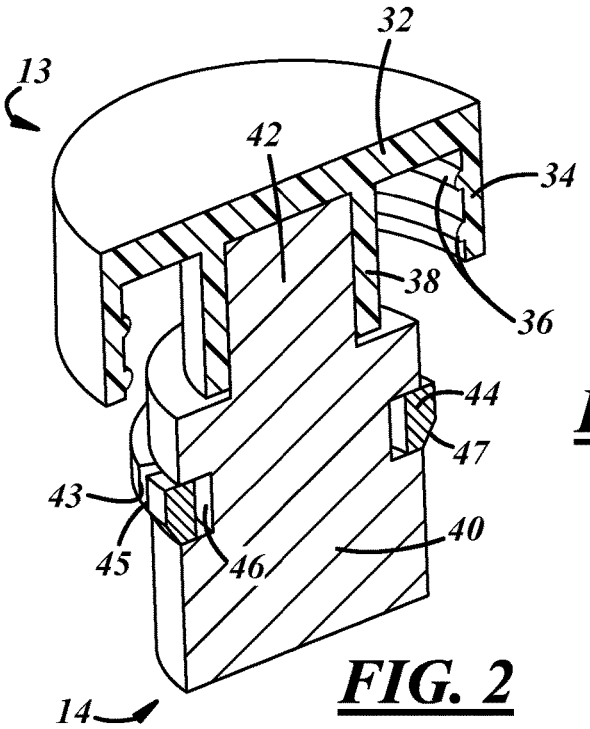
FIG. 2 is an enlarged fragmentary cross-sectional perspective view of the closure and indicator of FIG. 1.
Figure 3:
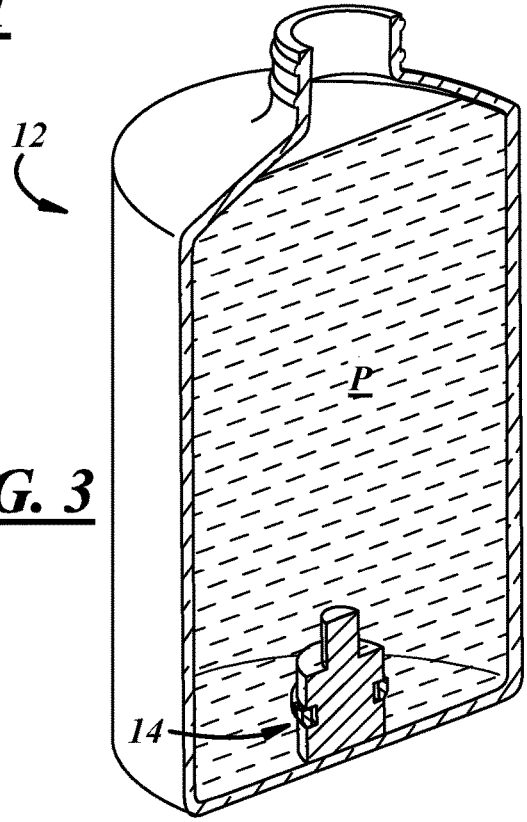
FIG. 3 is a cross-sectional elevational perspective view of the indicator of FIG. 1 shown located in the bottom of the container of FIG. 1.

The photochromic material is carried, directly or indirectly, by the container 10. In the embodiment illustrated in FIGS. 1-3, the photochromic material is carried by the container 12 via the indicator 14. More specifically, the indicator 14 includes the photochromic material. For example, the indicator 14 composition itself could include photochromic material. In another example, a substrate of the indicator 14 may be coated with a photochromic coating. In a further example, the indicator 14 may carry a separate photochromic component. Instead of, or in addition to, the indicator 14, the photochromic material provides a counterfeit deterrence feature that provides evidence that the original package 10 has been used. More specifically, the photochromic material may indicate design-intent use of the package 10, like first time or initial container opening after the package 10 is factory sealed.

The photochromic material may be darkened by exposure to ultraviolet (UV) light and, more specifically, may be darkened irreversibly according to design intent or ordinary use of the package 10, and not according to misuse or extraordinary conditions, for example, attempts to tamper with the package for counterfeiting, or the like. The UV light used to irreversibly darken the photochromic material preferably includes UVA and all ranges and subranges thereof, Near UV and all ranges and subranges thereof, or, more particularly, UV light greater than about 360 nm, as will be discussed further herein below.

Further, the package 10 includes a UV protector to protect the photochromic material from exposure to UV light, for example, before initial opening of the package 10, for example, by a customer. In the embodiment illustrated in FIGS. 1-3, the UV protector is carried by the container 12, either directly or indirectly. The UV protector may include any suitable UV blocking, UV absorbing, and/or UV retarding material or element of any kind. For example, UV protective material may include vanadium, selenium, carbon, iron, other glass colorant materials or colored glass, and/or the like. The UV protective material may be part of the container composition itself, a coating on interior and/or exterior surfaces of a substrate of the container 12, or the like. In a further example, the UV protector may be carried by the container 12 via the indicator 14. In other words, the UV protector may be applied to or integrated in the indicator 14, which is itself, of course, carried by the container 12. In another example, the UV protector may include a shrink sleeve (not shown) around the container and which includes UV protective material and which may be translucent or transparent. In any case, the UV protector may be provided over, around, or radially outward of, the photochromic material(s) to protect the material(s) from exposure to UV light from outside the package 10.

The container 12 may be of any suitable shape, and may include a jug, jar, bottle, other food or beverage container, or any other suitable container. The container 12 may include a base 15 on which the container 12 may be supported, a body 16 extending axially from the base 15, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to a container longitudinal central axis A. The body 16 and the neck 20 may be generally cylindrical, as illustrated, or they may be tapered or of any other suitable shape. The neck 20 may include a lip or axial outward end surface 22, and an interior surface 26. The neck 20 also may include a finish, which may include an external surface 28, and one or more threads or thread segments 30 projecting from the external surface 28, or the like for coupling to the closure 13. As used herein, the term thread segment includes whole, partial, multiple, and/or an interrupted thread, thread segment, and/or lug.

The container 12 may be of one-piece integrally formed construction, for example, of glass, plastic, or any other suitable material. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 12 may be fabricated in press-and-blow, blow-and-blow, or hand blowing glass container manufacturing operations, or in a plastic injection and/or blow molding operation, or in any other suitable manner.

The closure 13 may include a cap, cork, plug, or any other suitable type of closure, and may be composed of plastic, metal, glass, ceramic, or any other suitable material. The closure 13 may include a base wall 32, an annular outer skirt 34 extending from the base wall 32 and having one or more internal threads or thread segments 36 projecting from an internal surface thereof for coupling to the container 12, and an annular inner skirt 38 extending from the base wall 32 radially inward of the outer skirt 34.

The indicator 14 may include any suitable materials, components, or the like, and may be carried in any suitable location(s) of the container 12, internally and/or externally of the container 12. One or more portions of the indicator 14 may be non-removably secured to the container 12, or carried by the container 12 in any other suitable manner. The terminology "non-removably secured" includes a manner in which the indicator 14 is, by design-intent, not intended to be removed from the container 12 without damaging the container 12 and/or indicator 14 or otherwise visibly compromising the structural and/or functional integrity of either or both.

In the illustrated embodiment, the indicator 14 may be composed of plastic, metal, glass, ceramic, and/or any other suitable material, may take the form of a medallion or pendant, and may include a body 40, a closure coupling portion 42 extending from the body 40, and a resilient member 44 carried by the body 40. The body 40, closure coupling portion 42, and resilient member 44 are illustrated as having cylindrical shapes but may have any other suitable shapes. The resilient member 44 may be carried in an annular groove or relief 46 of the body 40, such that an inner diameter or dimension of the member 44 is less than an outer diameter or dimension of the body 40 but greater than the groove diameter or dimension. Accordingly, the member 44 may radially overlap, and may be axially trapped between axially facing shoulders of the body 40 on either side of the groove 46. In one embodiment, the member 44 may serve to non-removably retain the indicator 14 in the container 12. But in other embodiments, the indicator 14 and/or the container 12 may include any other suitable devices or features to non-removably retain the indicator 14 in the container 12.

The closure coupling portion 42 is illustrated as being detachably coupled to the closure 13 by a friction fit within the annular inner skirt 38 of the closure 13. But the closure coupling portion 42 may be detachably coupled to the closure 13 (or any other type of closure) by adhesive, integral frangible connectors, one or more magnets or separate releasable fasteners, or in any other suitable manner.

The resilient member 44 is illustrated in a rest state, but when the indicator 14 is assembled to the container 12, the resilient member 44 is compressible in a radially inward direction to a compressed state to allow the indicator 14 to be inserted into the container neck 20. For example, the member 44 may be C-shaped or semi-circumferential, having circumferential ends 43, 45. The member 44 may be composed of metal, ceramic, polymeric material, or any other suitable resilient material. Also, the member 44 may include an annular chamfer 47 to facilitate insertion of the indicator 14 into the container neck 20 under a force greater than that supplied by the weight of the indicator 14 alone. The member 44 is resiliently expandable from the compressed state back to the rest state when the member 44 axially traverses or clears an internal feature of the container 12. For example, the member 44 may axially clear a junction 19 of the neck 20 and the shoulder 18, whereafter the member 44 expands resiliently back to its rest state and a trailing surface or edge 48 of the member 44 is engageable with the junction 19.

At that point, the indicator 14 becomes non-removably secured within the container 12. When the closure 13 is displaced in a direction away from the container 12, the trailing edge 48 of the resilient member 44 axially engages the junction 19 such that continued displacement of the closure 13 out of the container 12 causes the indicator 14 to detach from the closure 13 and drop into the container 12. As used herein, the term "removal" may include partial or complete removal. Thereafter, the indicator 14 will not pass through the container neck 20 because the member 44 renders it too large to pass therethrough. Although the junction 19 is illustrated as an example of the container internal feature, any other suitable internal feature could be used, for example, internal embossments or steps (not shown) of the container neck 20, separate components installed in the neck 20, or any other suitable feature(s) to retain the indicator 14.

The photochromic material is responsive to a change in a state of the package 10 to change or modify an optical or visual characteristic visible from outside the container 12. In one embodiment, the change in state of the package 10 may include initial removal of the closure 13 from the container 12 after the package 10 was factory sealed. In another embodiment, the change in state of the package 10 may include a reduction in product P carried in the container 12. Accordingly, the photochromic material may indicate design-intent use of the package 10 such that a purchaser can see that the package 10 has been "used" after the package 10 was originally packaged with the product P carried in the container 12 and with the closure 13 coupled thereto. For example, the package 10 may be opened and then partially or completely emptied of its original flowable product P and, thereafter, if counterfeiters attempt to refill the emptied container 12 with counterfeit product and repackage the package 10 with the closure 13 (with or without closure seals or the like), the refilled and repackaged package 10 will include the state-changed indicator 14 as evidence that the package 10 is not original and, instead, has been refilled and repackaged. In other words, the container 12 (or package 10) may be permanently or irreversibly tagged as being a once-fillable container (or package). Over time, purchasers will become educated to spot refilled counterfeit packages. Thus, counterfeiters will be deterred from offering counterfeit packages to such educated purchasers.

The product P may be dispensably disposed within the container 12 of the package 10. For example, a product manufacturer may fill the container 12 with the authentic or original flowable product P at a packaging plant or factory and close the container 12 with the closure 13, which may be coupled to the neck 20 of the container 12 in any suitable manner. The product P may include a liquid or flowable solid, for example, a beverage, for instance, beer, wine, liquor, soda, or any other suitable beverage or liquid, or a flowable food of any kind. In one example embodiment, the closure 13 may be sealed to the container neck 20 with wax, with a paper or plastic seal, with a portion of the closure 13 itself, with a tamper evidence band, or with any other suitable seal or the like (not separately shown). Accordingly, the package 10 leaves the packaging plant in an original factory sealed condition. Thereafter, for example, after wholesale distribution or retail sale, the seal may be broken and the closure 13 removed to allow the product P to be dispensed out of the container 12 through the neck 20.

Figure 4:
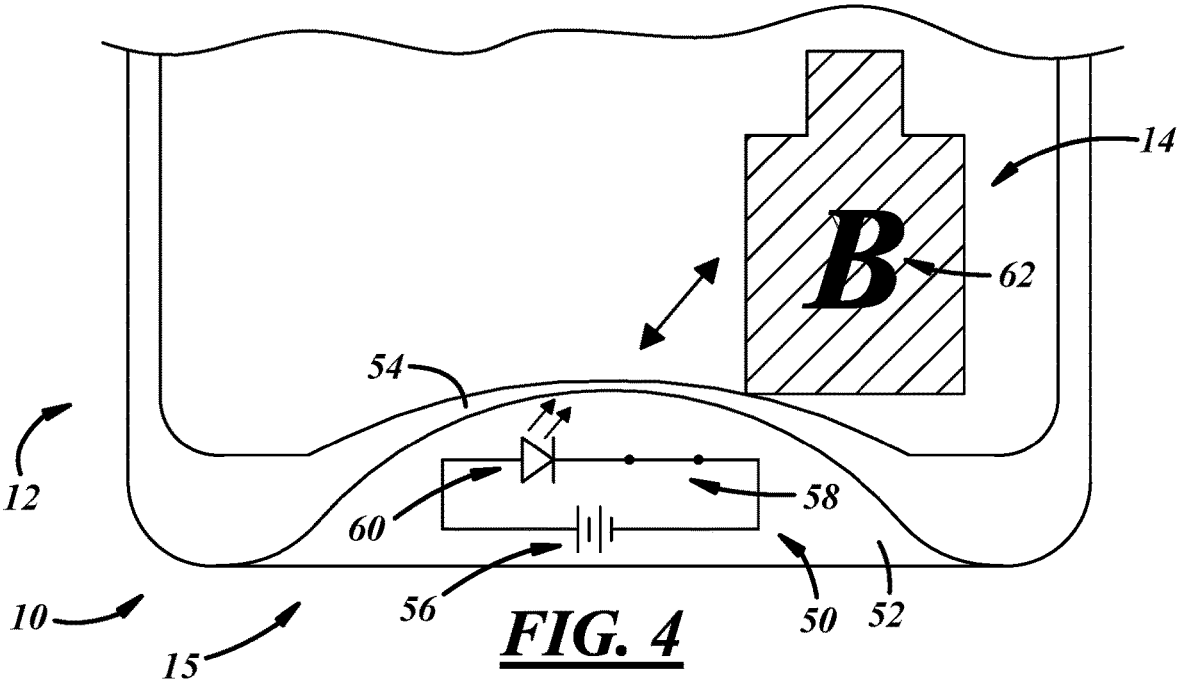
FIG. 4 is a fragmentary schematic view of a portion of the package of FIG. 1, illustrating the indicator in proximity of circuitry carried by the container of FIG. 1.

Referring to FIG. 4, the detached indicator 14 may be solid or otherwise not buoyant and, thus, is shown sunk to the inside bottom of the container 12. The base 15 of the container 12 may carry a lighting circuit 50. The lighting circuit 50 may be carried by a separate carrier 52, which may include a plate, plug, housing, circuit board, or the like and may be composed of glass, plastic, or any other suitable material. The carrier 52 may be separately coupled to the container base 15 in a non-removable manner. For example, the carrier 52 and circuit 50 may be located in a push up or punt 54 of the container base 15 and secured thereto with an epoxy, ceramic adhesive, potting compound, or the like.

The lighting circuit 50 may include a power source 56, a sensor 58, and at least one ultraviolet (UV) light source 60 switchably coupled to the power source 56 by the sensor 58. The power source 56 may include one or more batteries, quartz piezoelectrics, capacitors, solar cells, or any other suitable supply of electricity. The UV light source 60 may include one or more UV light emitting diodes (LEDs), or any other suitable source(s) of UV light. In one embodiment, one light source may emit light between 360 and 390 nm wavelength and all subranges therebetween and, more particularly between 365 and 385 nm wavelength and all subranges therebetween, or any other suitable wavelength. In another embodiment, the same or a second light source may emit light between 280 and 320 nm wavelength and all subranges therebetween and, more particularly, between 300 and 312 nm wavelength. The sensor 58 may include a capacitive proximity sensor, magnetic sensor (e.g. reed switch), photoelectric sensor, inductive proximity sensor, or any other suitable sensor or switch. Of course, different portions of the sensor 58 may be carried by different portions of the package 10.

The light source 60 may be activated in any suitable manner. In one example, the light source 60 may be activated upon detachment of the indicator 14 from the closure (not shown in FIG. 4). More specifically, a portion of magnetic sensor may be carried by the indicator 14 and another portion may be carried by the closure (not shown in FIG. 4), wherein separation of the indicator 14 from the closure 13 may close or trigger the sensor 58 to activate the light source 60. In another example, the light source 60 may be activated, for instance, by proximity of the drop indicator 14 to the sensor 58, which proximity may close or otherwise trigger the sensor 58 to activate the light source 60. In turn, the light emitted from the light source 60 impinges on the photochromic material of the indicator 14 so as to darken the indicator 14. A dark indicator would signal to a consumer that the container 12 has been opened from its original factory sealed condition.

The indicator 14 may include a contrast portion 62 that may be selectively pre-exposed to UV, selectively UV protected, or defined by a selectively applied ceramic label (ACL) process or the like. The portion 62 may include a decorative feature, for example, brand-reinforcing indicia, logo, name, slogan, or the like, or latent cautionary indicia as will be described below in accordance with other embodiments. Accordingly, before other portions have darkened, the contrast portion 62 may be darkened by pre-exposure to UV, or when other portions of the indicator 14 darken upon exposure to the UV light, the contrast portion 62 may be protected against darkening to stand out in contrast.

Figure 4A:
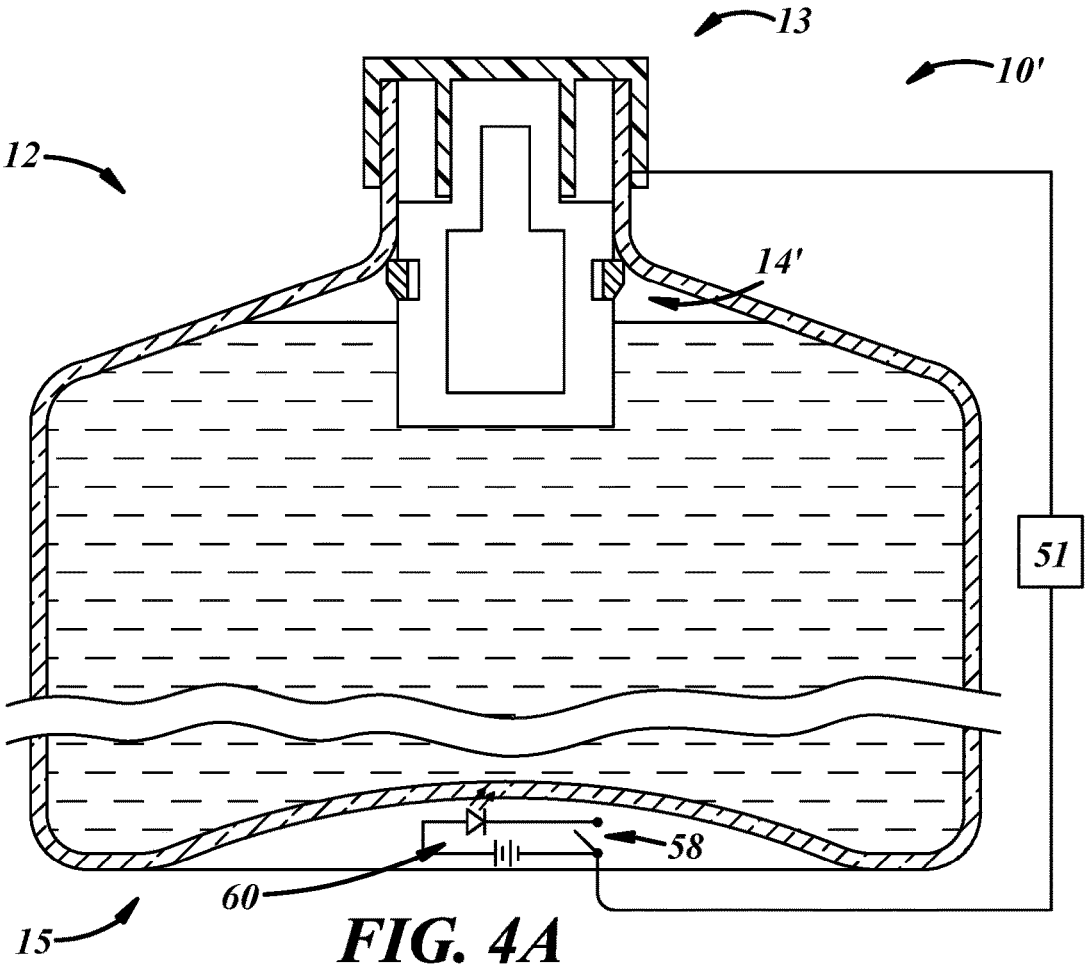
FIG. 4A is a fragmentary schematic view of a package according to another illustrative embodiment of the present disclosure, illustrating a circuit-type of package opening indicator.

FIG. 4A illustrates another illustrative embodiment of a package 10'. This embodiment is similar in many respects to the embodiment of FIGS. 1-4 and like numerals between the embodiments generally designate like or corresponding elements throughout the several views of the drawing figures. Accordingly, the descriptions of the embodiments are incorporated into one another, and description of subject matter common to the embodiments generally may not be repeated here.

In this embodiment, the light source 60 may be activated upon removal of the closure 13 from the container 12. For example, a package opening indicator 51 may include circuitry that may be carried by the container 12 between the light source 60 and the closure 13 so as to activate the sensor 58 when the closure 13 is removed from the container 12. Any suitable circuitry may be used including a capacitive proximity sensor, magnetic sensor (e.g. reed switch), photoelectric sensor, inductive proximity sensor, or any other suitable sensor or switch and related wiring, tracings, power supply, and/or the like. In addition, the package 10' may include a drop-style package opening indicator 14', for example, a hollow version of the indicator 14 of FIG. 1.

Figure 4B:
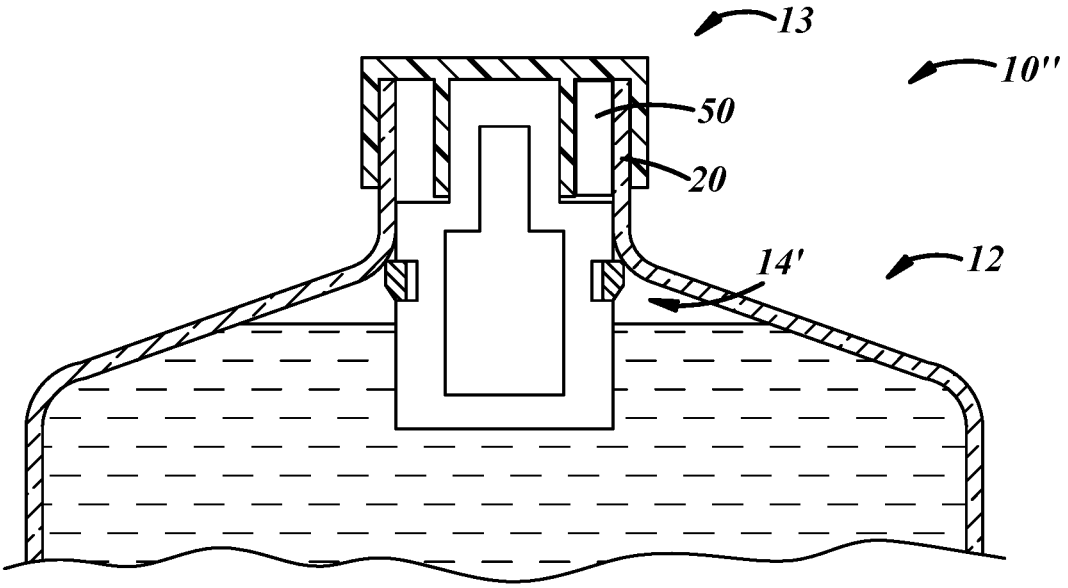
FIG. 4B is a fragmentary schematic view of a package according to a further illustrative embodiment of the present disclosure, illustrating another circuit-type of package opening indicator.

FIG. 4B illustrates another illustrative embodiment of a package 10". This embodiment is similar in many respects to the embodiments of FIGS. 1-4A and like numerals between the embodiments generally designate like or corresponding elements throughout the several views of the drawing figures. Accordingly, the descriptions of the embodiments are incorporated into one another, and description of subject matter common to the embodiments generally may not be repeated here.

In this embodiment, the lighting circuit 50 may be carried by the container neck 20 and may include the light source 60 (FIG. 4A) which may be activated upon removal of the closure 13 from the container 12. For example, as disclosed above, the lighting circuit 50 may include any suitable circuitry that, in this embodiment, may be carried by the container 12 between the closure 13 and the container neck 20 so as to activate the sensor 58 (FIG. 4A) when the closure 13 is removed from the container. Also, the package 10" may include the indicator 14' which may be hollow or otherwise buoyant in the product carried by the container 12.

Figure 5:
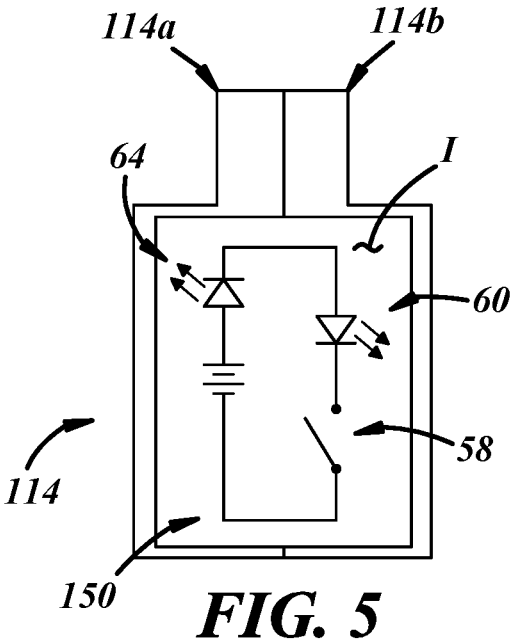
FIG. 5 is a schematic view of a package opening indicator according to an illustrative embodiment of the present disclosure, including light emitting circuitry.

FIG. 5 illustrates another illustrative embodiment of a package opening indicator 114. This embodiment is similar in many respects to the embodiment of FIGS. 1-4B and like numerals between the embodiments generally designate like or corresponding elements throughout the several views of the drawing figures. Accordingly, the descriptions of the embodiments are incorporated into one another, and description of subject matter common to the embodiments generally may not be repeated here.

In the illustrated embodiment, the indicator 114 includes a lighting circuit 150 and may be of multiple piece construction including, for example, two housing portions 114*a*, 114*b* that may be assembled together and may establish a hollow interior I. In another embodiment, the indicator 114 may include a one-piece housing molded or otherwise formed around the lighting circuit 150 and may or may not include a hollow interior. The indicator 114 may be buoyant, either by virtue of its hollow interior or by its material composition and/or construction. In another embodiment, the indicator 114 may be sinkable. In any case, the lighting circuit 150 may be substantially the same as that disclosed above, but also may include a visible light source 64. The visible light source 64 may include a light emitting diode, or any other suitable element that emits light visible to the human eye. The portions 114*a*, 114*b* may be coupled together in any suitable manner so as to seal the circuit 150 therein.

In this embodiment, one or more portions of indicator 114 may include photochromic material. For example, the material of which the indicator 114 is composed may include photochromic material. In another example, an interior surface of the indicator 114 may be coated with photochromic material. In this example, the UV protector may include a UV protective coating applied to the exterior surface of the indicator 114. In the illustrated example, the detachment of the indicator 114 from a closure may close or trigger the sensor 58 to activate the light source(s) 60. In turn, the light emitted from the light source 60 impinges on the photochromic material of the indicator 114 so as to darken the indicator 114. A dark indicator would signal to a consumer that the package 10 has been opened from its original factory sealed condition at some point.

Figure 6:
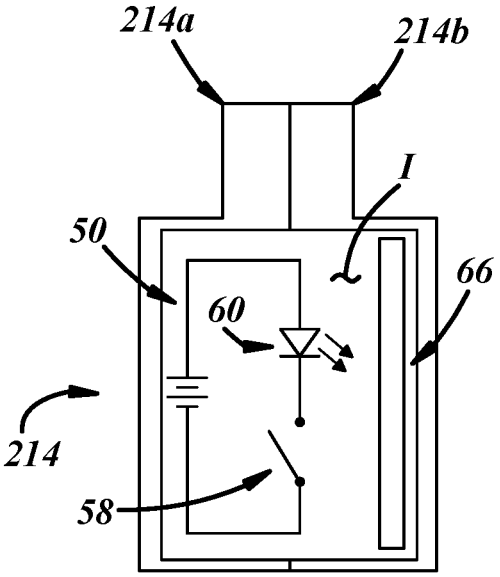
FIG. 6 is a schematic view of a package opening indicator according to another illustrative embodiment of the present disclosure, including light emitting circuitry and a photosensitive material.

FIG. 6 illustrates another illustrative embodiment of a package opening indicator 214. This embodiment is similar in many respects to the embodiments of FIGS. 1-5 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The indicator 214 may be of multiple piece construction including, for example, two housing portions 214*a*, 214*b* that may be assembled together and may establish a hollow interior I. In any case, the indicator 214 includes the lighting circuit 50, for example, carried in the hollow interior I of the portions 214*a*, 214*b*. In addition, in this embodiment, the indicator 214 includes and separately carries a separate photochromic element 66, which may be at least partially composed of and/or coated with the photochromic material. The portions 214*a*, 214*b* may be coupled together in any suitable manner so as to seal the circuit 50 and the photochromic element 66 therein. In this example, the UV protector may include a UV protective coating applied to the exterior and/or interior surface of the indicator 214. In the illustrated example, the detachment of the indicator 214 from a closure may close or trigger the sensor 58 to activate the light source 60. In turn, the light emitted from the light source 60 impinges on the photochromic element 66 so as to darken the photochromic element 66. The darkened element 66 inside the indicator 214 would signal to a consumer that the package 10 has been opened from its original factory sealed condition.

Figure 7:
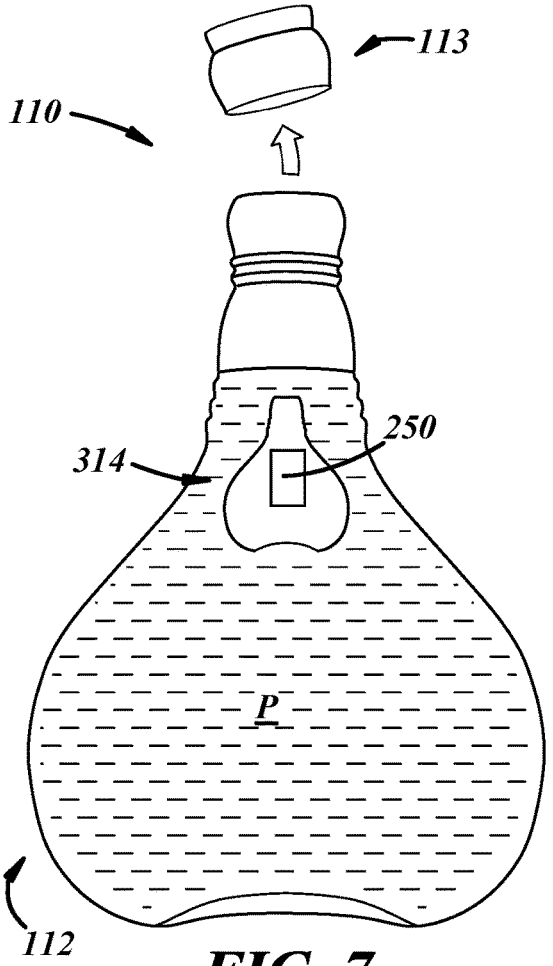
FIG. 7 is an elevational exploded view of a package according to another illustrative embodiment of the present disclosure, illustrating a closure being removed from a container and a package opening indicator falling down into the container.
Figure 8:
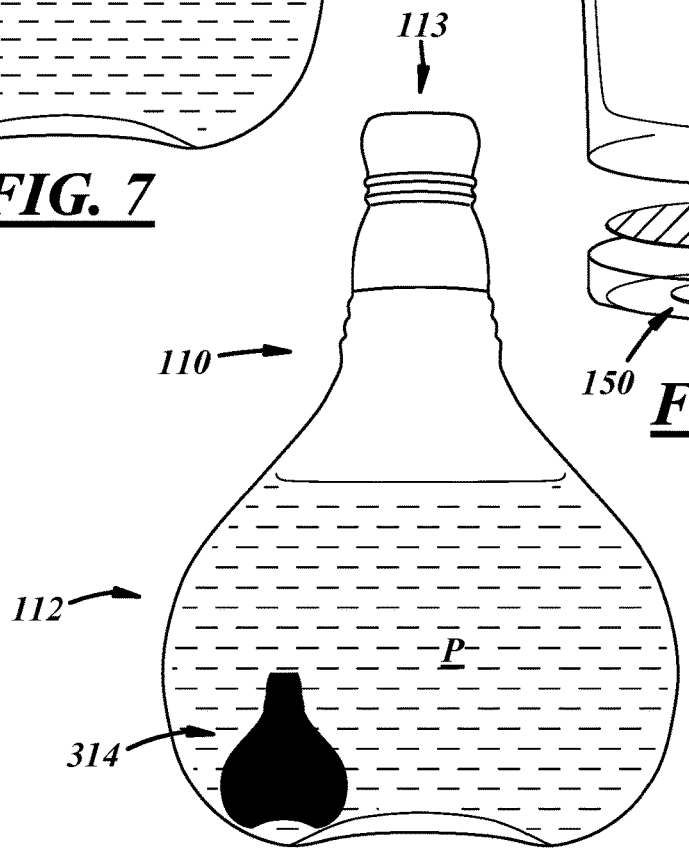
FIG. 8 is an elevational view of the package of FIG. 7, illustrating the indicator carried at the bottom of the container.

FIGS. 7 and 8 illustrate another illustrative embodiment of a package 110. This embodiment is similar in many respects to the embodiments of FIGS. 1-6 and like numerals between the embodiments generally designate like or corresponding elements throughout the several views of the drawing figures. Accordingly, the descriptions of the embodiments are incorporated into one another, and description of subject matter common to the embodiments generally may not be repeated here.

In this embodiment, the package 110 includes a package opening indicator 314 having a brand-reinforcing shape, for example, in the shape of a brand logo, brand package, or the like. FIG. 7 illustrates a closure 113 being removed from a corresponding container 112 and the indicator 314 having been detached from the closure 113 and dropping into the product P in the container 112. The indicator 314 may include a lighting circuit 250, which may be one of the previously disclosed circuits 50, 150. FIG. 8 illustrates the indicator 314 sunken to the bottom of the container 112 and darkened upon exposure to UV light.

Figure 9:
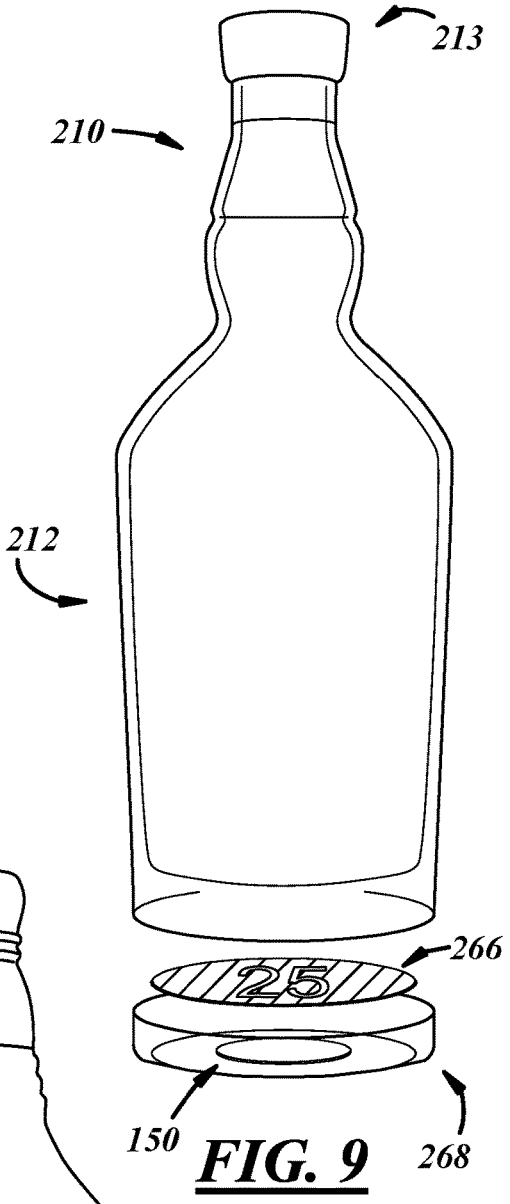
FIG. 9 is an exploded elevational view of a package according to a further illustrative embodiment of the present disclosure, illustrating a container, a separate base for coupling to the bottom of the container, and a photosensitive element interposed between the base and the container.
Figure 10:
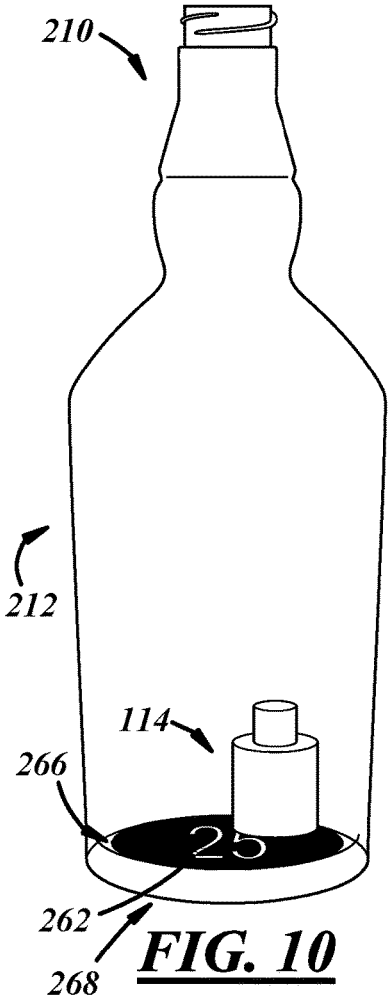
FIG. 10 is an elevational view of the package of FIG. 9, illustrating a package opening indicator disposed at the bottom of the container and the photosensitive element in an exposed state.

FIGS. 9 and 10 illustrate another illustrative embodiment of a package 210. This embodiment is similar in many respects to the embodiments of FIGS. 1-8 and like numerals between the embodiments generally designate like or corresponding elements throughout the several views of the drawing figures. Accordingly, the descriptions of the embodiments are incorporated into one another, and description of subject matter common to the embodiments generally may not be repeated here.

Referring to FIG. 9, the package 210 includes a container 212, a closure 213 coupled to the container 212, a separate container base 268 coupled to the container 212, the previously described lighting circuit 150, and a photochromic material 266 carried by the base 268. The package 210 also includes a UV light source that may be part of a lighting circuit (not separately shown), which may be carried by the base 268. The container 212 may include its own integral base or closed bottom end to which the separate base 268 may be coupled, or the container 212 may include an open bottom end to which the separate base 268 may be coupled. In any case, the separate base 268 may be non-removably coupled to the container 212, for example, via an epoxy, ceramic adhesive, glass solder or weld, or the like, or in any other suitable manner.

In one embodiment, the photochromic material 266 may be part of a separate photochromic element that may be carried by the base 268. In another embodiment, the base 268 may include the photochromic material 266, for example, a photochromic coating on an internal surface of the base 268 or photochromic material in the material composition of the base 268 itself.

In any case, the base 268 may carry a UV protector, for example, a UV protective coating on an external surface of the base 268, or UV protective material in the material composition of the base 268 itself. The UV protector also may include a separate element, for instance, a separate piece of UV protected glass (not shown) internally carried by the base 268 over the photochromic material. The separate piece of glass may include a UV protective coating, or may be composed of a UV protective material. In this example, the container 212 itself, apart from the base 268, would not require a UV protector.

Referring to FIG. 10, the package 210 may include a package opening indicator, for example, the indicator 114 from FIG. 5. The indicator 114 may be used to darken the photochromic material 266 of the base 268 to indicate that the package 210 has been opened from its original factory sealed condition. As shown, the photochromic material 266 may have a contrast portion 262, which may be masked, and pre-exposed to UV light or covered with a UV protector. This may be done, for example, to create a brand-reinforcing image, for instance, a logo, brand name, slogan, or the like, and/or to provide an additional security measure.

Figure 11:
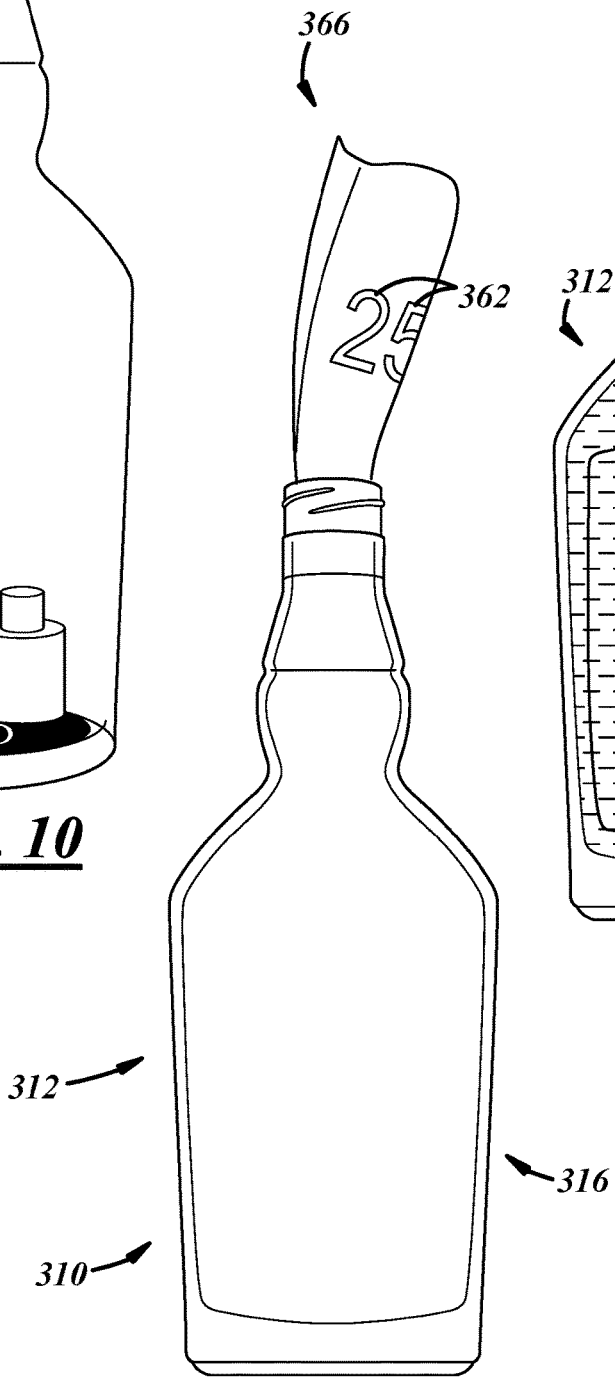
FIG. 11 is an elevational view of a photosensitive element being assembled into a container.
Figure 12:
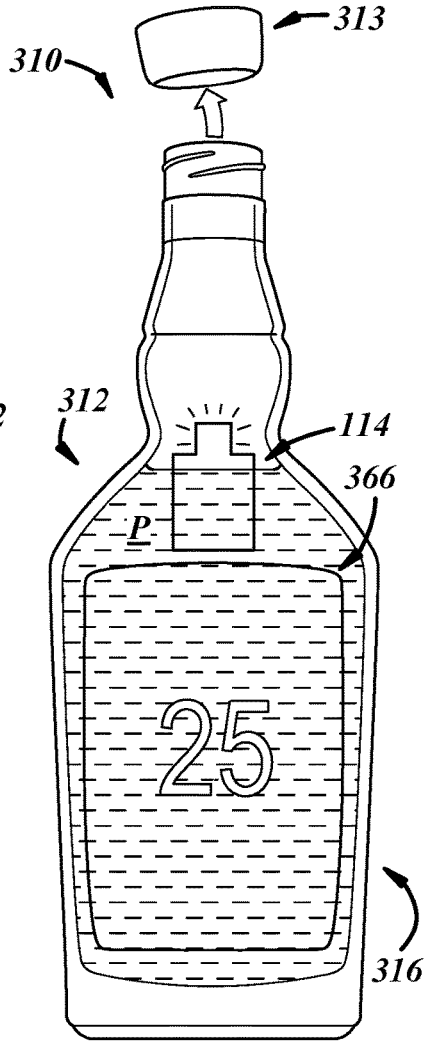
FIG. 12 is an exploded elevational view of a package according to an additional illustrative embodiment of the present disclosure, illustrating a closure being removed from the container of FIG. 11, the container carrying the photosensitive element, and a package opening indicator separated from the closure and floating in a product carried by the container.
Figure 13:
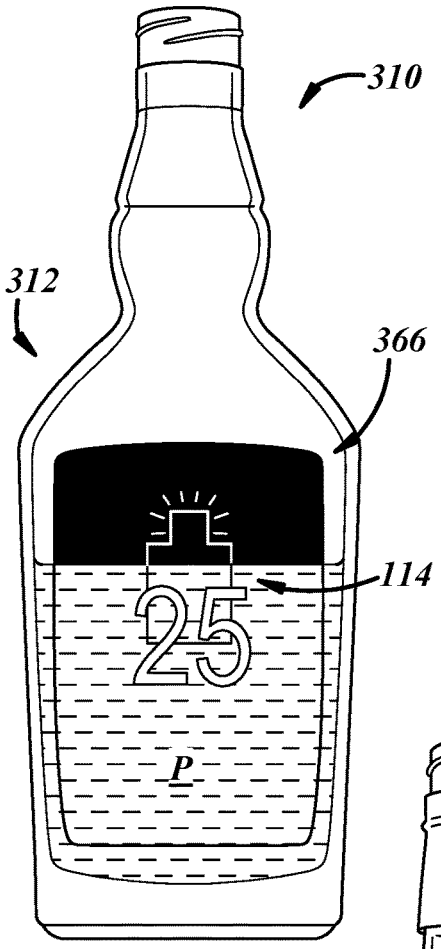
FIG. 13 is an elevational view of the container of FIG. 12, illustrating the photosensitive element in a partially exposed state corresponding to depletion of the product carried by the container.

FIGS. 11-13 illustrate another illustrative embodiment of a package 310. This embodiment is similar in many respects to the embodiments of FIGS. 1-10 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 11 illustrates the package 310 including a container 312 into which a flexible, coiled-up photochromic material 366 is being inserted. The photochromic material 366 may be a sheet of material, which may include a photochromic coating on a substrate or may include the sheet itself being composed, at least partly, of a photochromic material. The element 366 may be of any size or shape that fits into the container 312. The element 366 may be of such size that, when uncoiled in the container 312, the element 366 conforms to an interior surface of the container 312, for example, the interior surface of a body 316 of the container 312. In another embodiment, the element 366 may lay against the bottom of the container 312. The element 366 may include a contrast portion 362, as discussed previously. The element 366 may include flexible glass.

FIG. 12 illustrates the package 310 including a closure 313 being removed from the container 312, and a package opening indicator, for instance, the indicator 114 from FIG. 5, having been dropped from the closure 313 into the container 312, floating in product P contained therein, and emitting UV light.

FIG. 13 illustrates the package 310 wherein a portion of the product P has been dispensed from the container 312 such that the level of the product P is below a top edge of the photochromic material 366. Likewise, the indicator 114 has lowered below the top edge of the photochromic material 366 wherein UV light emitted from the indicator 114 has impinged on an upper portion of the photochromic material 366. Accordingly, the UV light may be emitted in such a manner that the photochromic material 366 is exposed and partially darkened as the level of the product P decreases to indicate that at least some of the original product P has been dispensed. The photochromic material 366 thus provides an indication of use of the package 310. As used herein, the term "use" may include design intent use, for example, package opening, product dispensing, and/or the like, but also may include unintended or unauthorized use, for example, product removal, product dilution, addition of counterfeit product, and/or the like.

Figure 14:
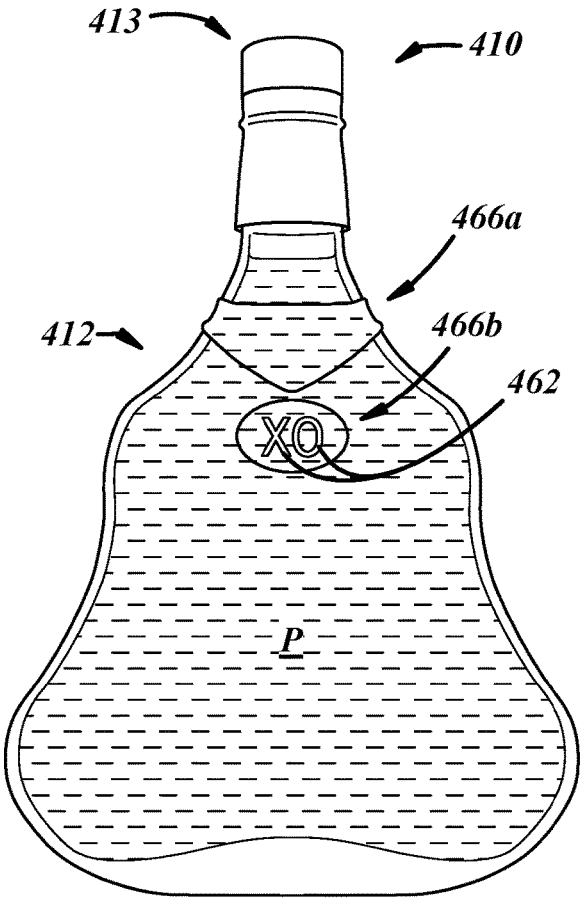
FIG. 14 is an elevational view of a package according to yet another illustrative embodiment of the present disclosure, illustrating a container with photosensitive materials in an unexposed state, and a closure coupled to the container.
Figure 15:
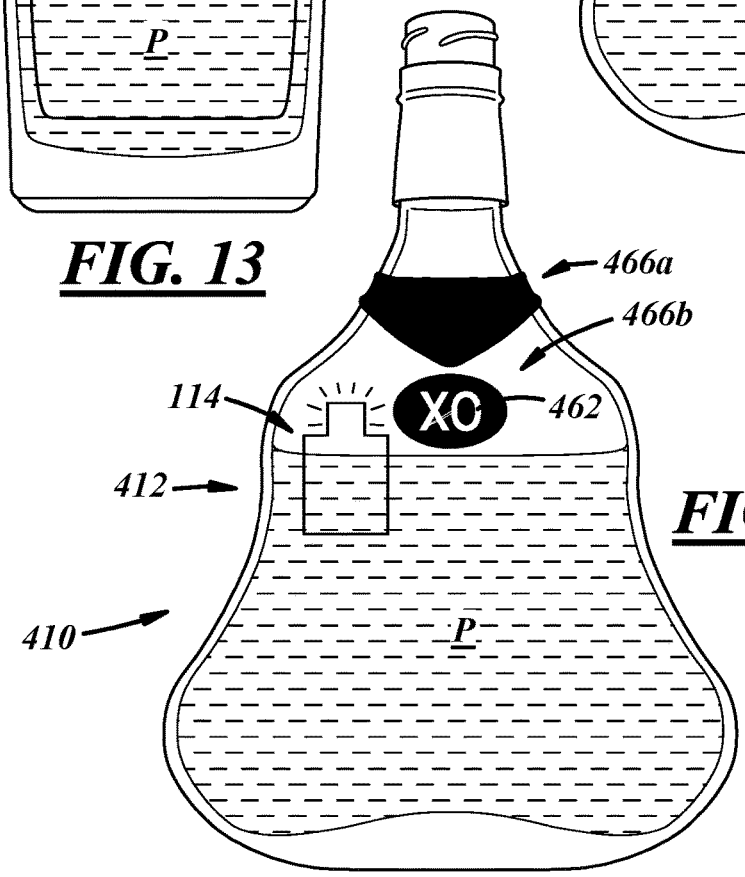
FIG. 15 is an elevational view of the package of FIG. 14, illustrating the closure removed from the container, and a package opening indicator floating in product carried by the container and the photosensitive materials in an exposed state.

FIGS. 14-15 illustrate another illustrative embodiment of a package 410. This embodiment is similar in many respects to the embodiments of FIGS. 1-13 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 14 illustrates the package 410 including a closure 413 coupled to a container 412, which includes one or more photochromic materials 466*a*, 466*b*. In one embodiment, the photochromic materials 466*a,b* may be integral with the container 412, for instance, internal or external embossments or debossments of the container 412 itself. In another embodiment, the photochromic materials 466*a,b* may be part of separate elements or emblems non-removably secured to an interior surface or an exterior surface of the container 412 in any suitable manner. The photochromic materials 466*a,b* may be in the form of a brand-reinforcing image, for instance, a logo, brand name, slogan, or the like. Also, or instead, the materials 466*a,b* may include contrast portions 462, as discussed previously.

FIG. 15 illustrates the package 410 including a package opening indicator, for instance, the indicator 114 from FIG. 5, having been dropped from the now-removed closure (not shown) into the container 412, floating in product P contained therein, and emitting UV light. Also, a portion of the product P has been dispensed from the container 412 such that the level of the product P is below top edges of the photochromic materials 466*a*, 466*b*. Likewise, the indicator 114 has lowered below the top edges of the photochromic materials 466*a,b* wherein UV light emitted from the indicator 114 has impinged on the photochromic materials 466*a,b*. Accordingly, the UV light may be emitted in such a manner that the photochromic materials are exposed and gradually darkened as the level of the product P decreases to indicate that at least some of the original product P has been dispensed.

Figure 16:
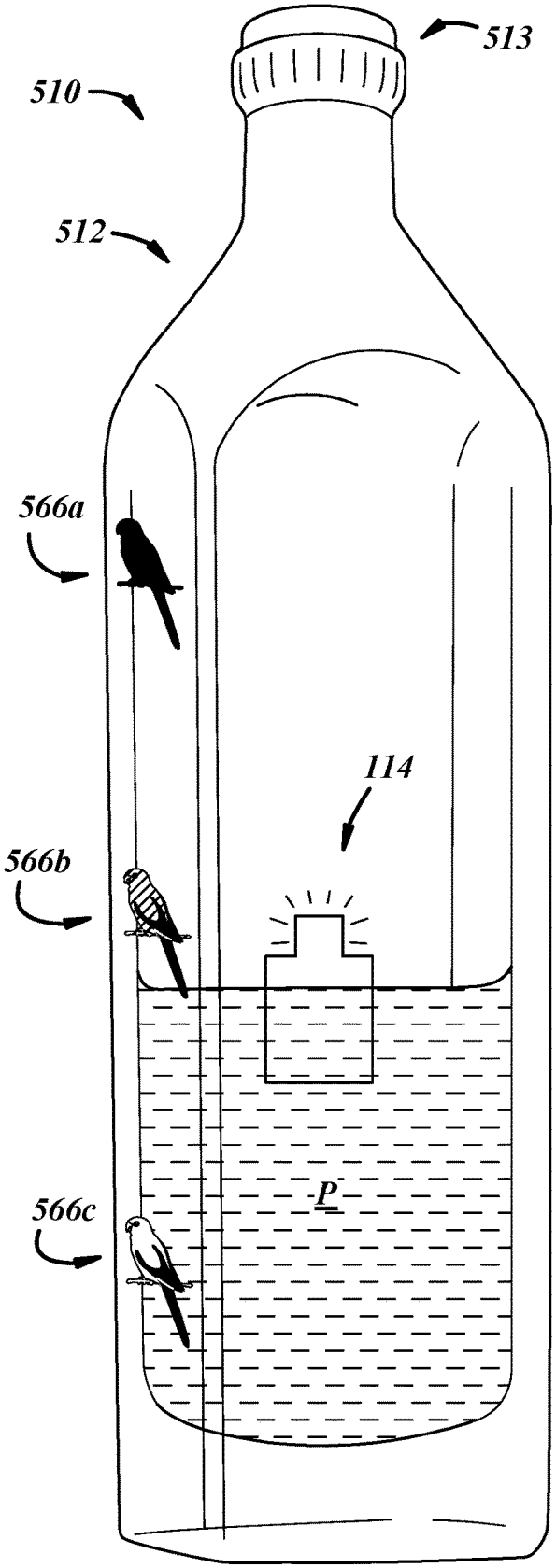
FIG. 16 is an elevational view of a package according to still another illustrative embodiment of the present disclosure, illustrating a container including photosensitive materials which are exposed, partially exposed, and unexposed, and a package opening indicator floating in a product carried by the container.

FIG. 16 illustrates another illustrative embodiment of a package 510. This embodiment is similar in many respects to the embodiments of FIGS. 1-15 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 16 illustrates the package 510 including a closure 513 coupled to a container 512, which includes one or more photochromic materials 566*a*, 566*b*, 566*c*, and a package opening indicator, for instance, the indicator 114 of FIG. 5. The photochromic materials 566*a,b,c* may be integral with the container 512, for instance, internal or external embossments or debossments of the container 512 itself, or may be part of separate elements non-removably secured to an interior surface or an exterior surface of the container 512 in any suitable manner, or may be coatings of photochromic material that may be applied with stencils or masks or in any other suitable manner. In embodiments where the materials 566*a,b,c* are applied or integrated into the exterior of the container 512, the container 512 may include a UV protective coating over the photochromic materials 566*a,b,c*.

In the illustrated embodiment of FIG. 16, the photochromic materials 566*a,b,c* may be vertically spaced apart and may be in the form of brand-reinforcing images, for instance, a logo, as shown. The indicator 114 has already been dropped from the closure 513 into the container 512, and is floating in product P contained therein, and emitting UV light. Also, a portion of the product P has been dispensed from the container 512 such that the level of the product P is entirely below a top one of the photochromic materials 566*a* and almost completely below an intermediate one of the photochromic materials 566*b*. Likewise, the indicator 114 has lowered below the top photochromic material 566*a* wherein UV light emitted from the indicator 114 has completely darkened the top element 566*a*, and is in the process of darkening an intermediate one of the materials 566*b*. Accordingly, the UV light may be emitted in such a manner that the photochromic materials 566*a,b,c* are exposed and gradually darkened as the level of the product decreases to indicate that at least some of the original product P has been dispensed. The photochromic material(s) 566 thus provide an indication of use of the package 510.

Figure 17:
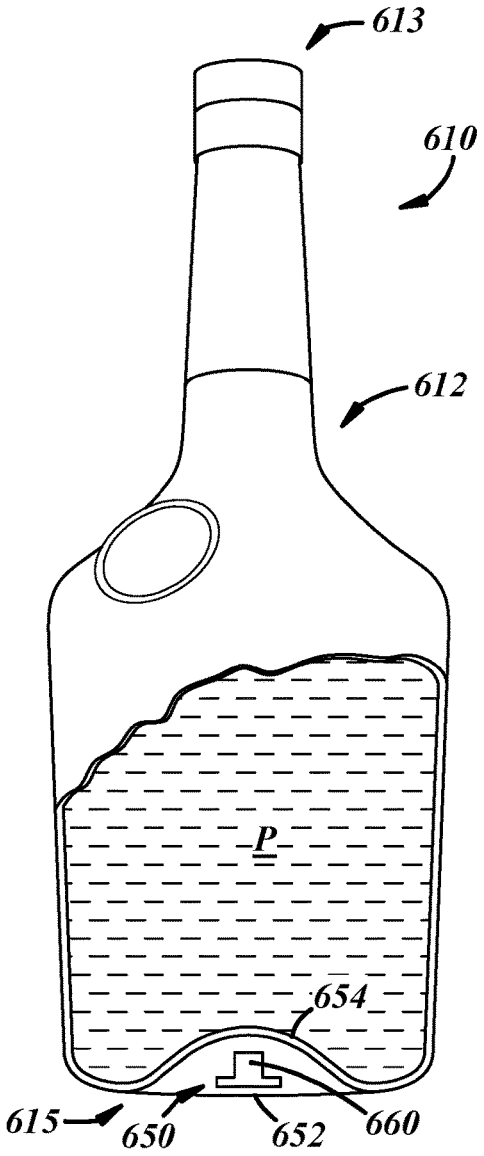
FIG. 17 is a fragmentary elevational view of a package according to yet a further illustrative embodiment of the present disclosure, illustrating a photosensitive container, a closure coupled to the container, and an ultraviolet (UV) light source carried by the container.
Figure 18:
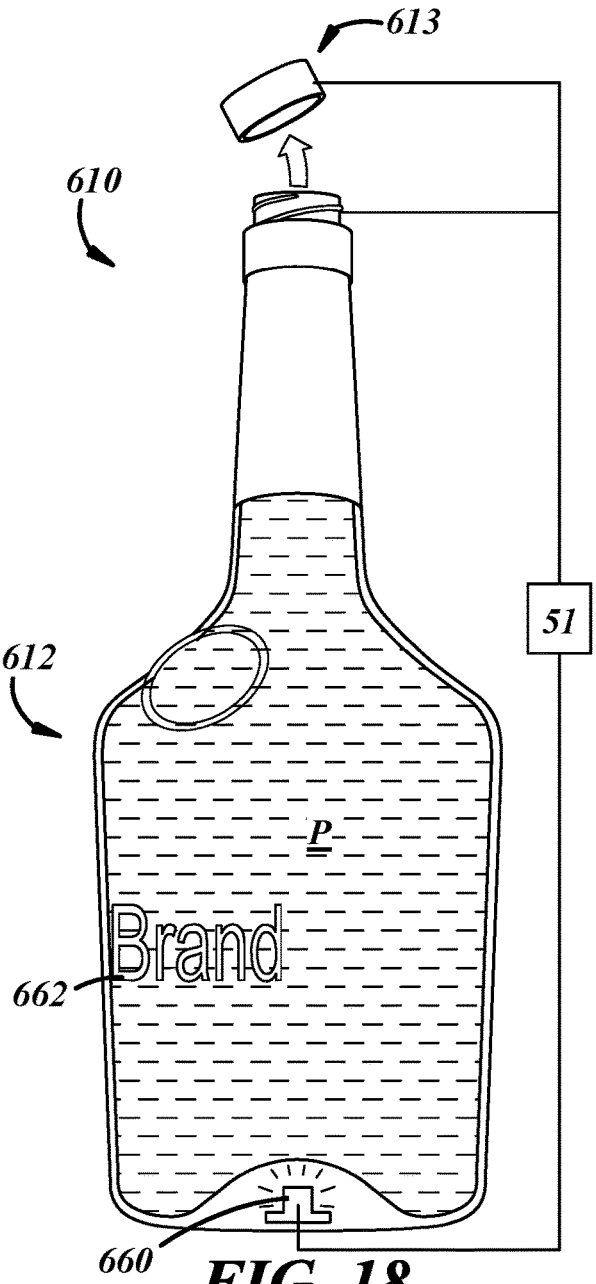
FIG. 18 is an elevational view of the package of FIG. 17, illustrating the closure being removed from the container and activation of the ultraviolet (UV) light source responsive to closure removal.
Figure 19:
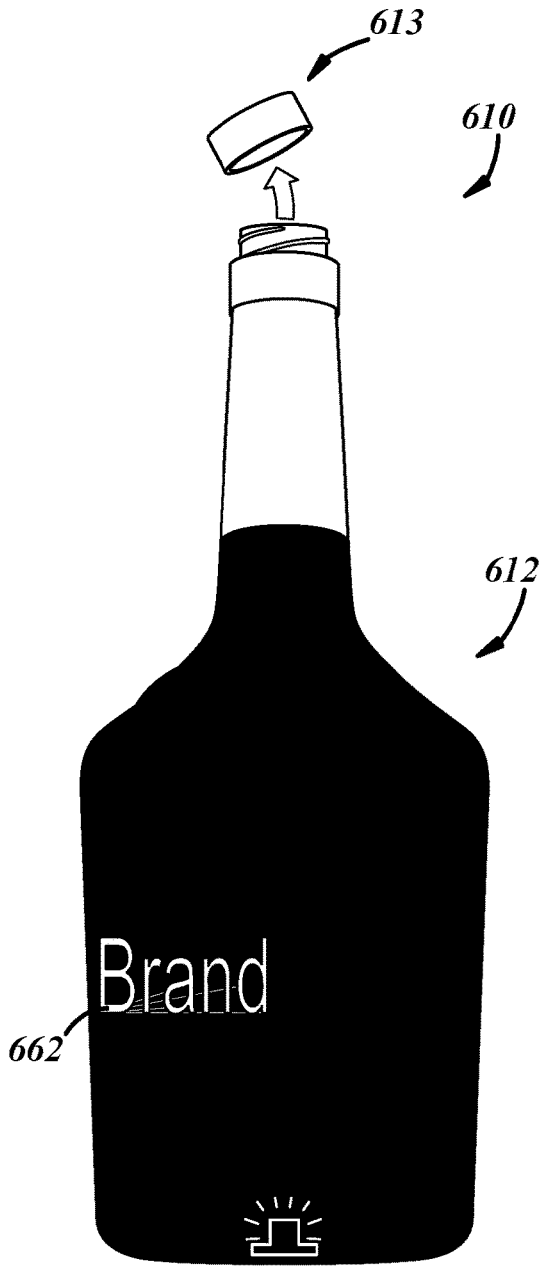
FIG. 19 is an elevational view of the container of FIG. 17 in an exposed state.

FIGS. 17-19 illustrate another illustrative embodiment of a package 610. This embodiment is similar in many respects to the embodiments of FIGS. 1-16 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 17 illustrates the package 610 including a container 612 carrying a photochromic material, a closure 613 coupled to the container 612, a UV light source 660, and any suitable circuitry to indicate package opening, for example, the previously described package opening indicator 51. The container 612 itself may be at least partially composed of the photochromic material. In one embodiment, the container 612 may have an internal and/or external photochromic coating. In another embodiment, the container 612 may be at least partially composed of a photochromic material. Likewise, the container 612 may include any suitable UV protective coatings and/or compositions. For example, the container 612 may be manufactured from separate glass gobs, for instance, a photochromic glass gob and a UV protective glass gob, so that the interior of the container 612 is a photochromic layer and the exterior of the container is a UV protective layer or casement. In this example, the container 612 may be hand blown from the separate gobs, or even automatically blown therefrom.

Also in the illustrated embodiment, the light source 660 is carried by a base 615 of the container 612 but, in other embodiments, the light source 660 may be carried by any other suitable portion(s) of the container 612 and/or an indicator, for instance, any of the drop indicators disclosed herein. In any event, the light source 660 may be part of a lighting circuit 650, for instance, like the lighting circuit of FIG. 4. In the illustrated embodiment, the light source 660 may be carried in a punt or push up 654 of the container base 615. For example, the light source 660 may be coupled to a carrier 652, which, in turn, is carried directly by the container base 615. For example, the carrier 652 may be non-removably secured to the container base by secured thereto with an epoxy, ceramic adhesive, glass solder or weld, or the like. Referring to FIG. 18, the light source 660 may be activated using the previously disclosed package opening indicator 51, when the closure 613 is removed from the container 612. As shown in FIG. 19, the entire container 612 may be darkened by exposure to UV light, except for a UV protected contrast portion 662, or the contrast portion 662 could be an applied ceramic label (ACL) to provide contrast.

In other embodiments, the light source 660 may be replaced by a sinking or floating indicator, for example, the indicator 114 of FIG. 5 having the light source 660 therein. In the floating indicator embodiment, the UV light may be emitted from the indicator 114 in such a manner that the photochromic container 612 is exposed and partially darkened as the level of the product P decreases to indicate that at least some of the original product P has been dispensed.

Figure 20:
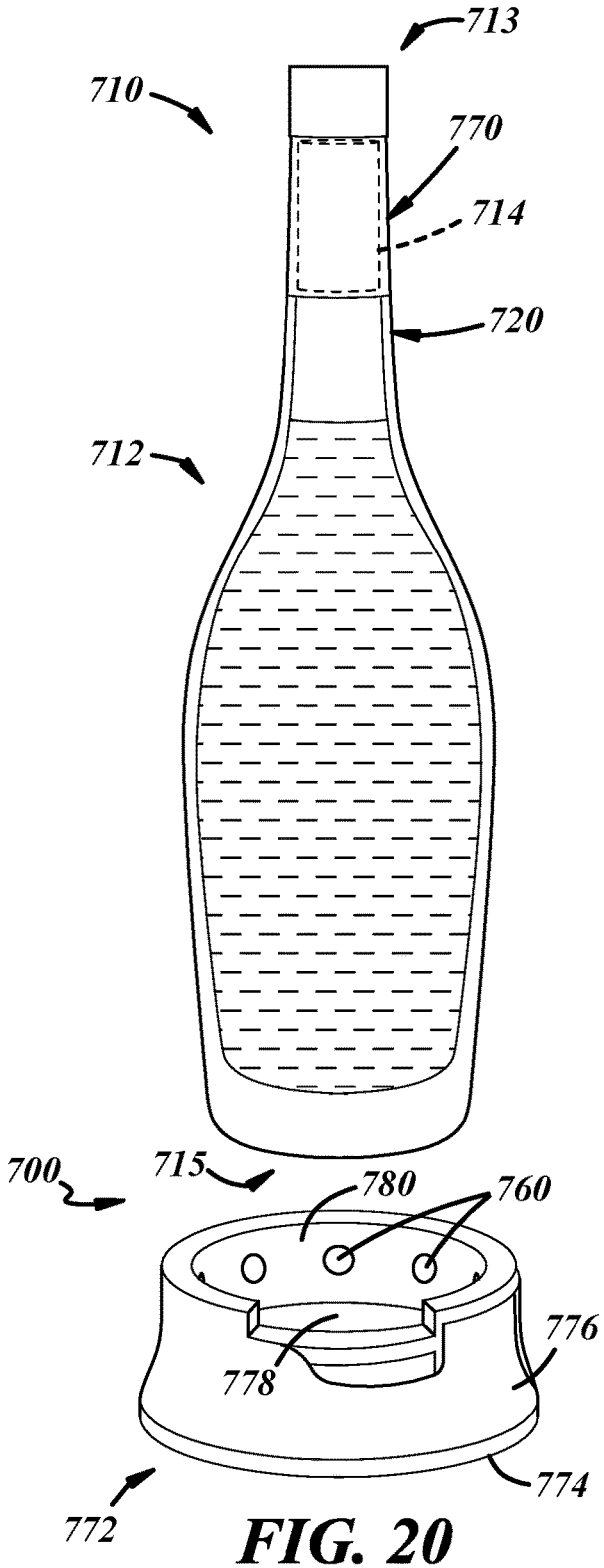
FIG. 20 is an exploded view of a packaging system according to an illustrative embodiment of the present disclosure, illustrating a display base including one or more ultraviolet (UV) light sources, and a package for receipt in the display base and including a container, a closure coupled to the container, and a package opening indicator coupled to the closure.
Figure 21:
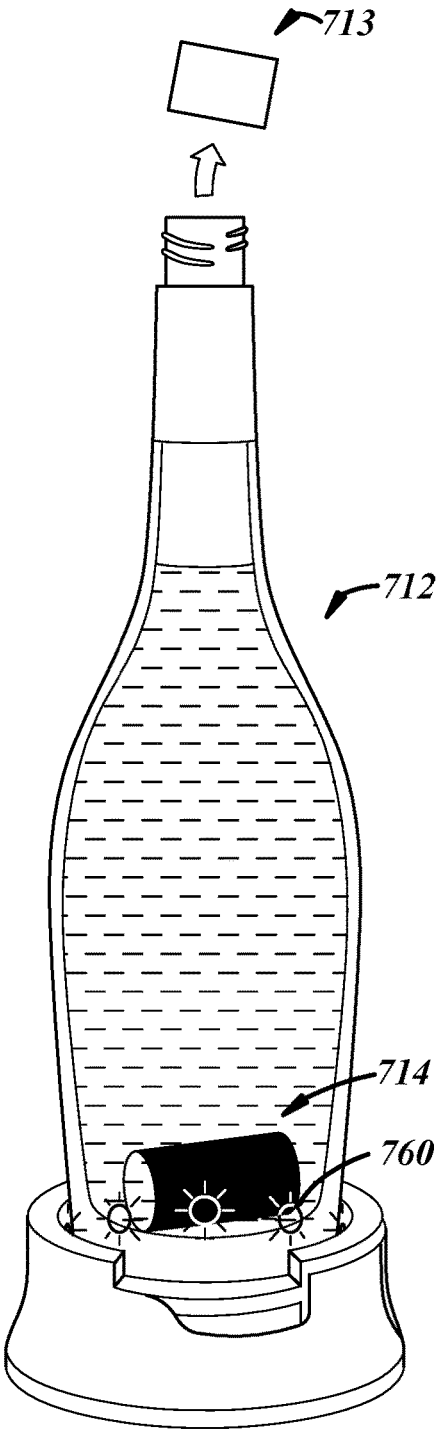
FIG. 21 is an assembly view of the packaging system of FIG. 20, illustrating the container with the closure removed and the indicator at a bottom of the container and shown in an exposed state.

FIGS. 20-21 illustrate another illustrative embodiment of a package 710. This embodiment is similar in many respects to the embodiments of FIGS. 1-19 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 710 includes a container 712, a closure 713 removably coupled to the container 712, and an opening indicator 714 detachably coupled to the closure 713 and carried in the container 712. The package 710 also may include a UV protective cover 770 carried around at least a portion of a neck 720 of the container 712 so as to protect the indicator 714. The package 710 may be part of a system 700 that also includes a delivery device or UV lighting base 772 on which the package 710 may be carried. The lighting base 772 may include one or more UV light sources 760, which may be part of a lighting circuit, for example the lighting circuit of FIG. 5. The base 772 may include a bottom wall 774, side walls 776 extending from the bottom wall 774, and a container base support wall 778 disposed inwardly of the side walls 776 and on which the container base 715 may be rested. The base 772 also may include an extension wall 780 extending in a direction away from the support wall 778 for surrounding a lower portion of the container 712. In the illustrated embodiment, the extension wall 780 may carry the light sources 760, which may be distributed in an annular array. In other embodiments, the support wall 778 also, or instead, may carry the light sources 760.

As shown in FIG. 21, the closure 713 may be removed from the container 712 wherein the indicator 714 detaches from the closure 713 and falls to the inside bottom of the container 712. Thereafter, the container 712, with or without the closure 713 reapplied thereto, may be placed on the lighting base 772. When the container 712 is carried on the lighting base 772, the light sources 760 may be activated via any suitable circuitry, which may include a weight sensor, proximity sensor, a manual switch, or may be activated in any other suitable manner. Accordingly, the UV responsive indicator 714 darkens upon exposure to UV light emitted from the UV light sources 760. In the illustrated embodiment, the indicator 714 includes a bottom surface that is not UV sensitive, and a cylindrical outer surface that is UV sensitive. For example, the outer surface of the indicator 714 may be coated with a photochromic material.

Figure 22:
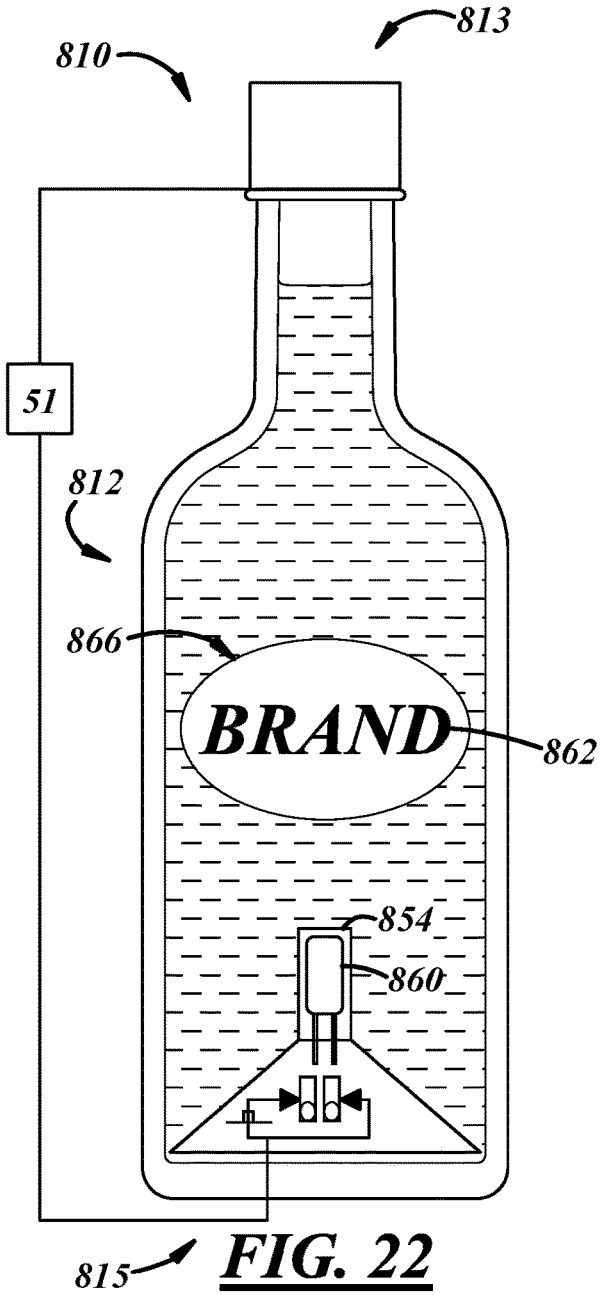
FIG. 22 is an elevational view of a package according to still a further illustrative embodiment of the present disclosure, illustrating a container, a closure coupled to the container, a photosensitive material carried by the container, and an ultraviolet (UV) light source carried by the container to activate the photosensitive material responsive to opening of the package.
Figure 23:
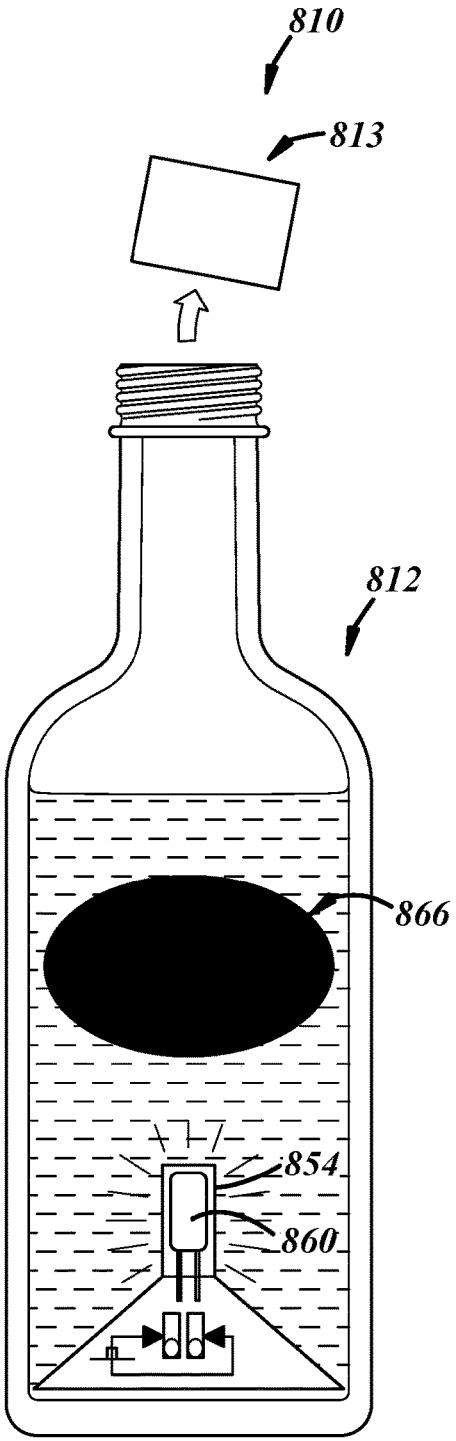
FIG. 23 is exploded elevational view of the package of FIG. 22, illustrating the closure removed from the container and the photosensitive material in an exposed state.

FIGS. 22-23 illustrate another illustrative embodiment of a package 810. This embodiment is similar in many respects to the embodiments of FIGS. 1-21 and like numerals between the embodiments generally designate like or corresponding elements throughout the several views of the drawing figures. Accordingly, the descriptions of the embodiments are incorporated into one another, and description of subject matter common to the embodiments generally may not be repeated here.

Referring to FIG. 22, the package 810 includes a container 812, a closure 813 coupled to the container 812, a UV light source 860 carried by the container 812, a photochromic material 866 carried by the container 812, and a circuit-type of package opening indicator carried by the container 812. For example, the light source 860 may be activated using the previously disclosed package opening indicator 51 when the closure 813 is removed from the container 812.

The light source 860 may be part of a lighting circuit, for example, the lighting circuit of FIG. 4, and may be carried by the container base 815, for instance, in a punt or push up 854 thereof. The light source 860 and/or lighting circuit may be non-removably secured to the container 812, for instance, using epoxy, potting compound, or any other suitable material, or in any other suitable manner.

In one embodiment, a photochromic material 866 may be a portion of the container 812 itself. In another embodiment, the photochromic material 866 may be part of a separate element, for example, a borosilicate photochromic piece of glass that is thermally treated at a temperature below its softening point to cure the glass. In the illustrated embodiment, a mask or stencil may be applied to the photochromic material 866 and a contrast portion 862 thereof may be exposed to UV light to darken the exposed areas to produce a pre-exposed contrast portion, for example, a brand name, logo, slogan, or the like.

A UV protector may be applied over the photochromic material 866. For example, a UV protective coating may be applied over the exterior of the container 812, excluding a portion of the base 815 corresponding to the light source 860 for example, the punt 854.

Referring to FIG. 23, the closure 813 may be removed from the container 812 for the first time after being factory sealed. Removal of the closure 813 may activate the light source 860. UV light emitted from the light source 860 impinges on a back side of the photochromic material 866 and travels through the photochromic material 866 to darken the previously UV-unexposed portions of the photochromic material 866 so that the entire photochromic material 866 is darkened to indicate to a consumer that the package 810 has been opened from its original factory sealed condition.

Figure 24:
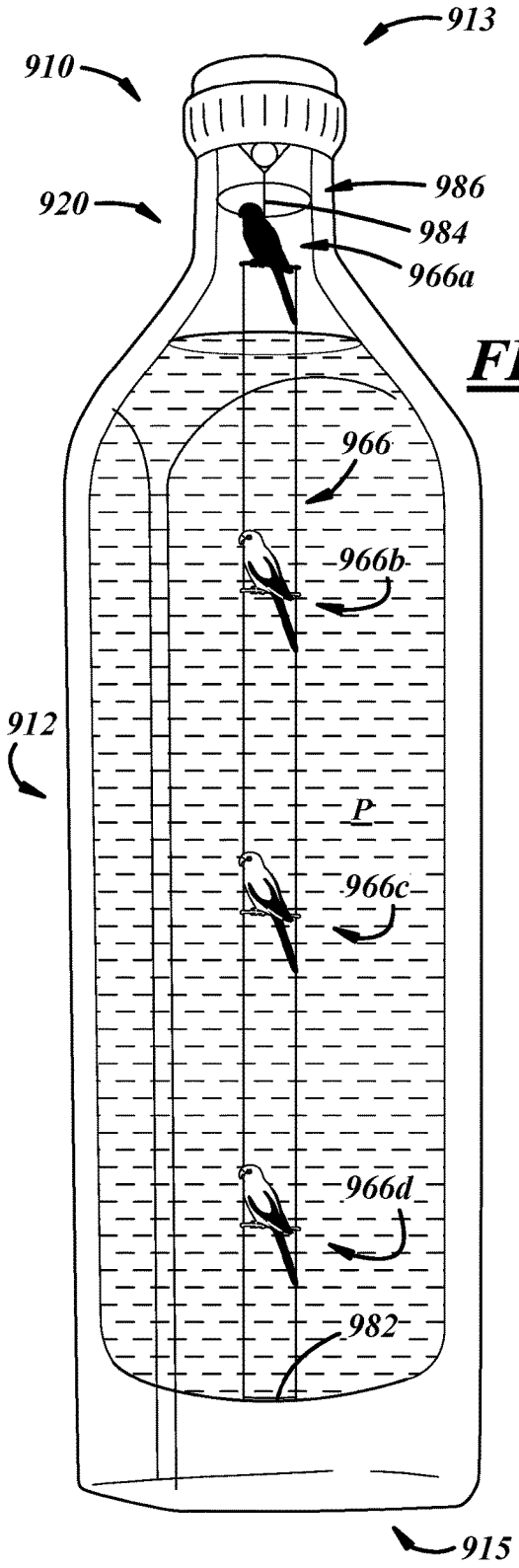
FIG. 24 is an elevational view of a package according to yet a further illustrative embodiment of the present disclosure, illustrating a container, a closure coupled to the container, and a photosensitive material carried by the container.

FIG. 24 illustrates another illustrative embodiment of a package 910. This embodiment is similar in many respects to the embodiments of FIGS. 1-23 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 910 includes a container 912, a closure 913 coupled to the container 912, and an photochromic material 966 carried in the container 912. The photochromic material 966 may be part of an elongate element, taking the form of a rod having a base end 982 supported by a base of the container 912. For example, the base end of the rod may be welded to an inside surface of the container base 915, for example, while one or both of the container 912 are sufficiently hot to integrally bond corresponding surfaces thereof. In other examples, the base 982 end of the rod may be adhered, fastened, or otherwise coupled to the base 915 of the container 912. The rod may include one more brand-reinforcing elements 966*a*, 966*b*, 966*c*, 966*d*, for example, logos, initials, or the like.

Opposite the base end 982, the rod may include a finish end 984. In one embodiment, the finish end 984 may be coupled to or, an integral portion of, an anti-refill dispensing fitment 986 or the like. Such fitments are well known to those of ordinary skill in the art, and any suitable fitment may be used. The fitment 986 may be non-removably secured to the container 912 by way of the element 966 and/or by any suitable non-removable connection between the fitment 986 and the container neck 920. In another embodiment, the finish end 984 may be coupled to or may include an expandable element, for instance, like that of FIG. 1, to support the rod.

In one embodiment, portions of the rod may be masked and pre-exposed to UV light, for example, to better define the brand-reinforcing elements. In another embodiment, portions of the rod may be covered with a UV protector, for example, to provide or better define an anti-counterfeit security measure. For instance, a mask or stencil may be applied to the rod and, thereafter, UV light may be applied to the rod to darken exposed portions of the rod, or a UV protective coating may be applied to the exposed portions.

The product P carried by the container 912 may be of a type that tends to absorb UV light. Some spirits, for example, cognac, scotch, and the like absorb much of the UV spectrum and can be used as the UV protector for the photochromic material 966. Accordingly, as shown in FIG. 24, an upper portion of the rod above the level of the product P is shown darkened from exposure to UV light traveling through the container 912, but other portions (excluding pre-exposed portions) of the rod below the level of the product P are not yet darkened because the product P protects the rod from UV exposure. The photochromic materials 966 thus provides an indication of use of the package 910.

In another embodiment, although not illustrated in FIG. 24, the package may include a UV light source that may be used to activate the photochromic material. For example, a light source may be carried by the neck 920 and may be activated by closure removal, for example, as discussed above with respect to FIG. 4B. In another example, a light source may be carried by a floating device like that described above with respect to FIG. 5.

FIGS. 25A-25E illustrate another illustrative embodiment of a package 1010. This embodiment is similar in many respects to the embodiments of FIGS. 1-24 and like numerals between the embodiments generally designate like or corresponding elements throughout the several views of the drawing figures. Accordingly, the descriptions of the embodiments are incorporated into one another, and description of subject matter common to the embodiments generally may not be repeated here.

Figure 25B:
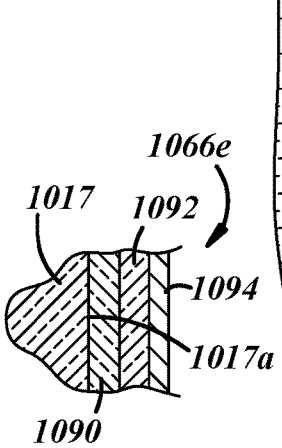
FIG. 25B is an enlarged, fragmentary view of a portion of the package of FIG. 25A, taken from circle 25B of FIG. 25A.
Figure 25A:
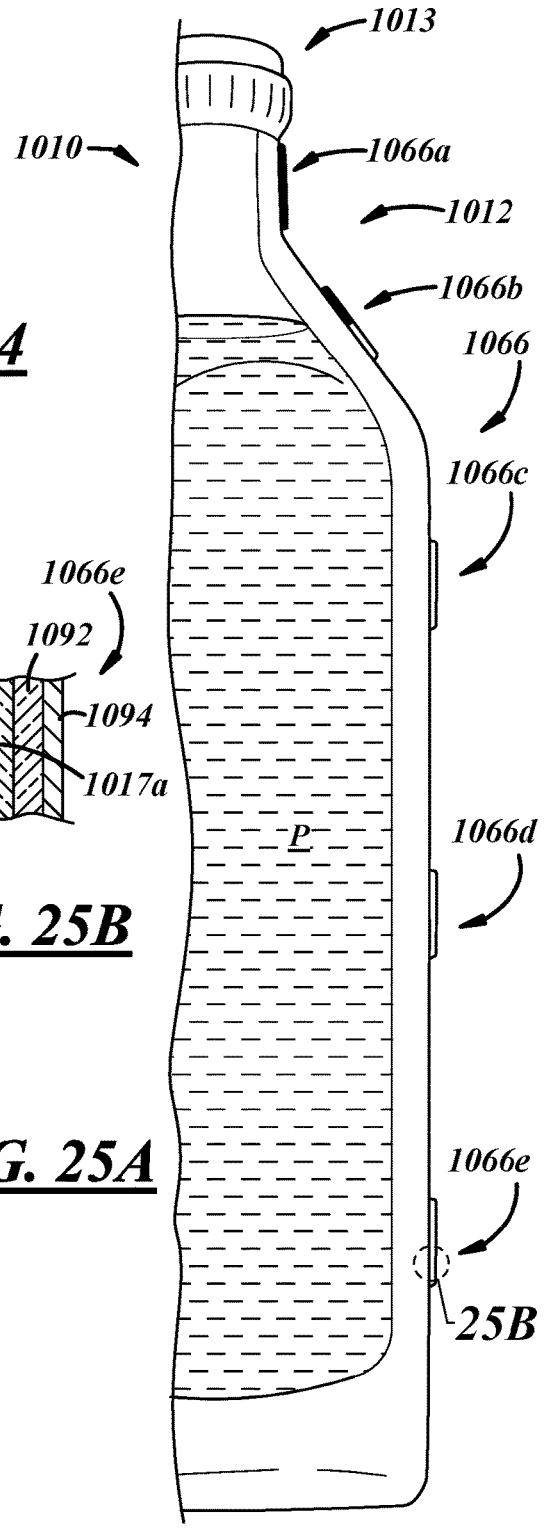
FIG. 25A is an elevational view of a package according to still another illustrative embodiment of the present disclosure, illustrating a container, a closure coupled to the container, and a plurality of photosensitive elements carried by the container.

With reference to FIG. 25A, the package 1010 includes a container 1012, a closure 1013 coupled to the container 1012, and a photosensitive material 1066, which may include a continuous strip or a plurality of discrete and separate portions or elements 1066*a-e* carried on an exterior surface of the container 1012 axially along the container 1012. As used herein, the term "photosensitive" includes, by design intent, the properties of visible darkening or latent image forming after exposure to UV light.

In one embodiment, the photosensitive materials 1066*a-e* may be carried on a minor circumferential portion of the container 1012, in other words, over less than half of the circumference of the container 1012. For example, the photosensitive materials 1066*a-e* may be carried on one circumferential side of a multi-sided container, or on a portion of a cylindrical container less than 180 degrees around the container 1012 and, more particularly, on about 90 degrees of the container 1012. In another embodiment, the photosensitive materials 1066*a-e* may be carried circumferentially completely around the container 1012, for example, where each of the materials 1066*a-e* are selectively UV protected, for instance, with selective UV protective coatings.

The product P carried by the container 1012 may be of a type that tends to absorb UV light, for example, cognac, scotch, or the like. Accordingly, as shown in FIG. 25A, an upper one of the materials 1066*a* above the level of the product P is shown darkened from exposure to UV light traveling through the container 1012, a second one of the materials 1066*b* is partially darkened, and the other elements 1066*c-e* below the level of the product P are not yet darkened because the product P protects those portions from UV exposure. The photosensitive materials 1066 thus provide an indication of use of the package 1010.

Referring now to FIG. 25B, each of the materials 1066*a-e* may include a plurality of layers. For example, a first layer 1090 of a first photosensitive material may be carried on an exterior surface 1017*a* of a wall 1017 of the glass container 1012, and a second layer 1092 of a second photosensitive material, which may be different from the first photosensitive material, may be carried by the first layer 1090. The first layer 1090 may be a counterfeit or tamper evident layer, and the second layer 1092 may be a use or opening indicating layer. The first and second layers 1090, 1092 may have different activation modes. For example, the first layer 1090 may be photothermochromic, whereas the second layer 1090 may be photochromic.

In the first instance, exposure of the first layer 1090 to UV light may produce a latent image that is not visible until heated to a point at which the first layer 1090 becomes irreversibly darkened and, thus, visible. In other words, the first layer 1090 material may be responsive to UV light exposure so as to form a latent image that may be darkenable or otherwise made visible after exposure to heat, for instance, at elevated temperatures below the softening temperature of the glass to which the photothermochromic material is applied and, preferably, below a reset temperature of the photochromic material. Those of ordinary skill in the art will recognize that such temperatures are application-specific, and will vary widely dependent on the particular photosensitive materials selected and the particular glass substrate to which the materials are applied. In one example, exposure of the entirety of the first layer 1090 to UV light may produce a latent dark surface over the first layer 1090 until the first layer 1090 is heated. In another example, where the first layer 1090 includes latent cautionary indicia, exposure of the first layer 1090 to UV light will produce a latent cautionary image until the first layer 1090 is heated. Accordingly, as used herein, the term "photothermochromic" includes, by design intent, the property of visible darkening after exposure to UV light and subsequent exposure to heat.

Conversely, exposure of the second layer 1092 to UV light may darken the layer 1092 irreversibly under ordinary conditions, either from a UV light source (not shown) carried by the container 1012 or a base (not shown) therefore, or by ambient UV light. But the first layer 1090 would remain translucent or transparent under such conditions. However, if a counterfeiter tampered with the container 1012 under extraordinary conditions, for example, melting a fitment or otherwise applying heat to the container 1012, then the first layer 1090 would react by irreversibly darkening to provide evidence of such misuse or extraordinary conditions. Accordingly, as used herein, the term "photochromic" includes, by design intent, the property of visible darkening after exposure to UV light, wherein subsequent exposure to heat is not necessary. Also, as used herein, the term "visible" includes visible to the human eye at arm's length in indirect sunlight.

Figure 25C:
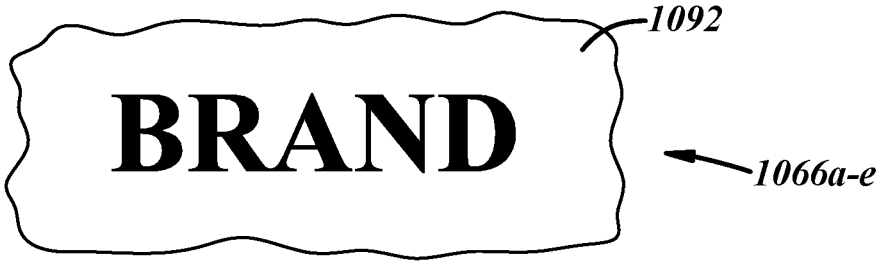
FIG. 25C is an enlarged, fragmentary view of a portion of a photosensitive material of the package of FIG. 25A, illustrating a darkened portion, pre-exposed to UV light.
Figure 25D:
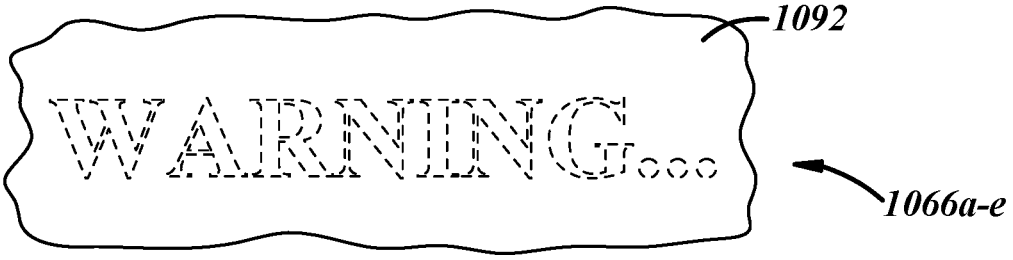
FIG. 25D is an enlarged, fragmentary view of a portion of a photosensitive material of the package of FIG. 25A, illustrating a latent image portion formed by pre-exposure to UV light.
Figure 25E:
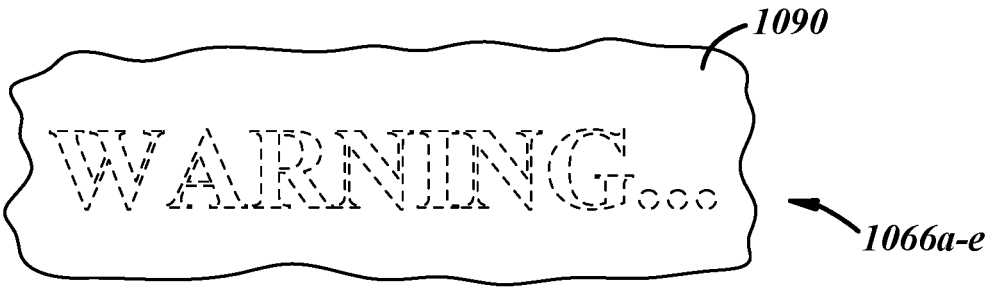
FIG. 25E is an enlarged, fragmentary view of a portion of a photosensitive material of the package of FIG. 25A, illustrating a latent image portion established by selective application of a UV protector.

Referring to FIGS. 25C, 25D, and 25E, in some embodiments, the materials 1066*a-e* may include contrast portions. For instance, the materials 1066*a-e* may be selectively pre-exposed to UV light, selectively covered with ACL material, and/or may be selectively covered with a UV protector. For example, a brand-reinforcing image may be defined, for instance, a logo, brand name, slogan, or the like. In another example, latent indicia may be established, for instance, latent cautionary indicia. In a first example, with reference to FIG. 25C, a mask or stencil may be applied to the materials 1066*a-e* (for example, the second layers 1092 thereof) and, thereafter, UV light may be applied to the materials 1066*a-e* to darken unmasked or exposed parts of each of the materials 1066*a-e* to produce a brand-reinforcing image. In this example, when the package 1010 is opened and the material 1066*a* is exposed to UV light, portions of the material 1066*a* that were not pre-exposed would darken thereby effectively causing the brand-reinforcing image to disappear. In a second example, with reference to FIG. 25D, the materials 1066*a-e* (for example the second layers 1092 thereof) may be selectively covered by a UV protector, to create latent cautionary indicia, for instance, "WARNING: Container Has Been Opened" any other suitable text, symbol, or the like. The cautionary statement is latent because it is not visible until the second layer 1092 is exposed to UV light. In a third example, with reference to FIG. 25E, a UV protective coating may be selectively applied to the materials 1066*a-e* (for example the first layers 1090 thereof) to UV protect portions of the materials 1066*a-e* to either provide a latent brand-reinforcing image or to provide latent cautionary indicia. More particularly, the first layer 1090 may have a contrast portion that does not darken upon darkening of other portions of the first layer 1090. For example, the contrast portion may include latent cautionary indicia, for instance, "WARNING: Container Has Been Tampered With" or any other suitable text, symbol, or the like. The cautionary indicia is latent because it is not visible until the first layer 1090 is exposed to elevated temperatures that cause darkening of the non-UV-protected portions. Selective application of the contrast material may include use of masks, stencils, screens, spray nozzles, spray heads, or the like. The UV pre-exposed or UV protected portion of the contrast portion may be adjacent to (for example surrounded by, or vice-versa) an unexposed or uncovered portion to provide contrast.

In other embodiments, the cautionary or other indicia may be established by the shape or outline of the materials 1066. In other words, the layer(s), emblems, and the like may be shaped as any suitable text, symbol, or the like, such that masking and the like is not required.

The first layer 1090 may include a first metal halide containing glass, and the second layer 1092 may include a second metal halide containing glass that may be different from the first metal halide containing glass. For example, the photothermochromic material of the first layer 1090 may include a metal halide material, which may include silver and/or gold with chlorine, bromine, and/or iodine halides. The photothermochromic material may include any suitable material selected from the group(s) consisting of the aforementioned materials, or from any other suitable photothermochromic material(s). Photothermochromic materials, in and of themselves, and their application to glass, are well known to those of ordinary skill in the art, as illustrated by U.S. Pat. Nos. 2,515,936 and 2,515,937. Also, the photosensitive material of the second layer 1092 may include any suitable other metal halide material, which may include silver, copper, and/or cadmium with chlorine halide, bromine halide, and/or iodine halide. The photochromic material may include any suitable material selected from the group(s) consisting of the aforementioned materials, or from any other suitable photochromic material(s).

The layers 1090, 1092 may be produced and applied by ACL or in a manner similar to ACL, which techniques—in and of themselves—are well known to those of ordinary skill in the art. For example, a metal halide containing glass may be produced, pulverized into fine particles of glass, and combined with organic binders, lubricants, flowing agents, and the like to produce a compound that can be heated and flowed onto the container 1012 exterior using screen printing or any other suitable techniques. Thereafter, the container 1012 with the layers 1090, 1092 thereon may be heat treated, for example, through a decoration lehr to sinter the glass particles of the layers 1090, 1092 onto the container 1012. The layers 1090, 1092 may be produced and applied in any other suitable manner using any other suitable technique(s).

In one embodiment, the entire exterior of the container 1012 may carry a UV protector, for example, a coating, sleeve, or the like. In this embodiment, although not illustrated in FIG. 25A or 25B, the package 1012 may include a UV light source that may be used to activate the photosensitive material(s), as per any of the aforementioned embodiments. In another embodiment, a UV protector may include a UV protective coating or the like selectively applied to the exterior of the container 1012 over the individual elements 1066*a-b*, and also may include a whiskey, cognac, or other UV absorbing product carried by the container 1012 to provide further UV protection.

For example, as shown in FIG. 25B, the UV protector may include a third layer 1094 carried by the second layer 1092. The third layer 1094 may include a translucent or transparent UV protective coating that may be sprayed, screen printed or the like to the container 1012 over the second layer 1092. Or the third layer 1094 may include vanadium containing glass that is pulverized and applied over the other two layers 1090, 1092 by screen printing or the like, and then sintered with the other two layers 1090, 1092. Or, the third layer 1094 may include a dark color curable ink that inhibits UV transmission.

Referring to FIG. 25A, in a further embodiment, the UV protective coating or the like may be selectively applied to the exterior of the container 1012 on only the one side (or sub-180 circumferentially angular degree portion) of the container 1012 on which the individual elements 1066*a-b* are disposed. In either of these embodiments, the whiskey, cognac, or other UV absorbing product would prevent UV light from reaching the materials 1066 until the level of the product dropped below the location of the photosensitive materials 1066. At that point, ambient UV light could penetrate the UV-unprotected walls of the container 1012 and impinge on the rear of the photosensitive materials 1066*a-e* and thereby darken those portions.

In any case, the UV protector may be used to protect the photothermochromic material (in addition to the photochromic material) from exposure to UV light.

Figure 26:
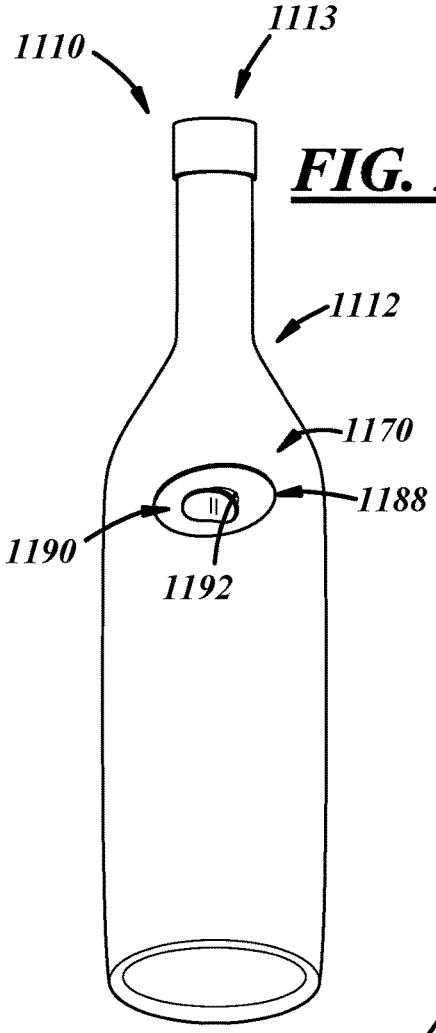
FIG. 26 is an elevational view of a package according to another illustrative embodiment of the present disclosure, illustrating a photosensitive container, a closure coupled to the container, and an ultraviolet protector carried by the container.

FIG. 26 illustrates another illustrative embodiment of a package 1110. This embodiment is similar in many respects to the embodiments of FIGS. 1-25E and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1110 includes a container 1112, a closure 1113 coupled to the container 1112, and a UV protector 1170, which may be an opaque or UV protective cover or appliqué applied to an exterior surface of the container 1112 and that may include a UV protectant material and having at least a portion that is removable from the container 1112. The protector 1170 may include a product label. In the illustrated embodiment, the appliqué may include a first portion 1188 that may be adhered or otherwise secured to the container, and a second portion 1190 that may be removably coupled to the container via the first portion 1188. For instance, the second portion 1190 can be removably adhered to the first portion 1188. The first portion 1188 may have an opening 1192 over which the second portion 1190 may be laid. Removal of the second portion 1190 exposes the opening 1192 to allow the previously unexposed portion of the container 1112 to be exposed to UV light.

In one embodiment, the interior of the container 1112 carries a UV protector and the exterior of the container 1112 carries a photochromic material. For example, a UV protective coating may be applied on the inside of the container 1112 and a photochromic coating may be applied to the outside of the container 1112. In another example, the inside portion of the container 1112 is partially composed of a UV protective material, and the outside portion of the container 1112 is partially composed of a photochromic material. Also according to this embodiment, the UV protector 1170 is applied to the exterior of the container 1112, and the rest of the exterior of the container 1112 is exposed to UV light to darken the container exterior. The portion of the container 1112 covered by the UV protector 1170 remains undarkened. The container 1112 may be filled with product and delivered to a customer. In another embodiment, a whiskey, cognac, or other UV absorbing product may carried in the container 1112 to provide further UV protection. Before the customer opens the package 1110, the customer may peel back the UV protector 1170 to expose the previously unexposed portion of the container 1112 to UV light. The UV light may be ambient UV light or may be UV light provided by an external device, for example, like that disclosed with respect to FIGS. 20 and 21.

Figure 27:
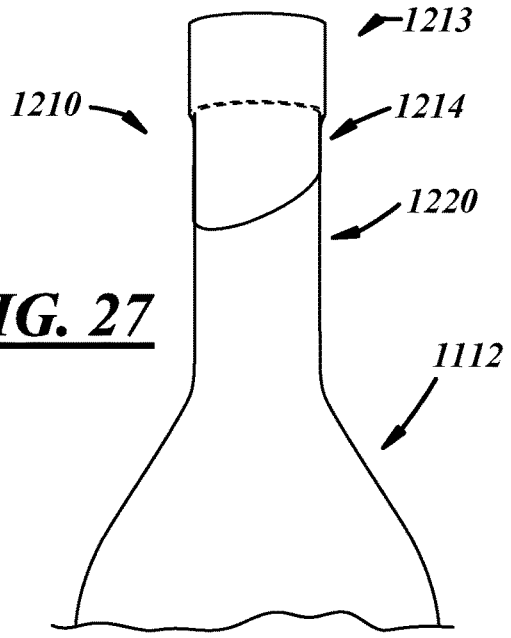
FIG. 27 is an elevational view of a package according to another illustrative embodiment of the present disclosure, illustrating a photosensitive container, a closure coupled to the container, and an ultraviolet protector carried by the container and coupled to the closure.

FIG. 27 illustrates another illustrative embodiment of a package 1210. This embodiment is similar in many respects to the embodiments of FIGS. 1-26 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1210 is substantially similar to that disclosed above with respect to FIG. 26, including the container 1112 from FIG. 26. But the package 1210 includes a closure 1213 and a UV protector 1214 covering at least a portion of a neck 1220 of the container 1112 and coupled to the closure 1213 in such a manner that removal of the closure 1213 causes removal of the UV protector 1214. Accordingly, when a customer opens the package 1210, displacement of the closure 1213 with respect to the container 1112 will peel back the UV protector 1214 to expose the underlying previously unexposed portion of the container 1112 to UV light. If the underlying portion of the container 1112 is already darkened, then the customer will know that the product is counterfeit. Otherwise, the customer will be assured that the product is genuine and original.

Figure 28:
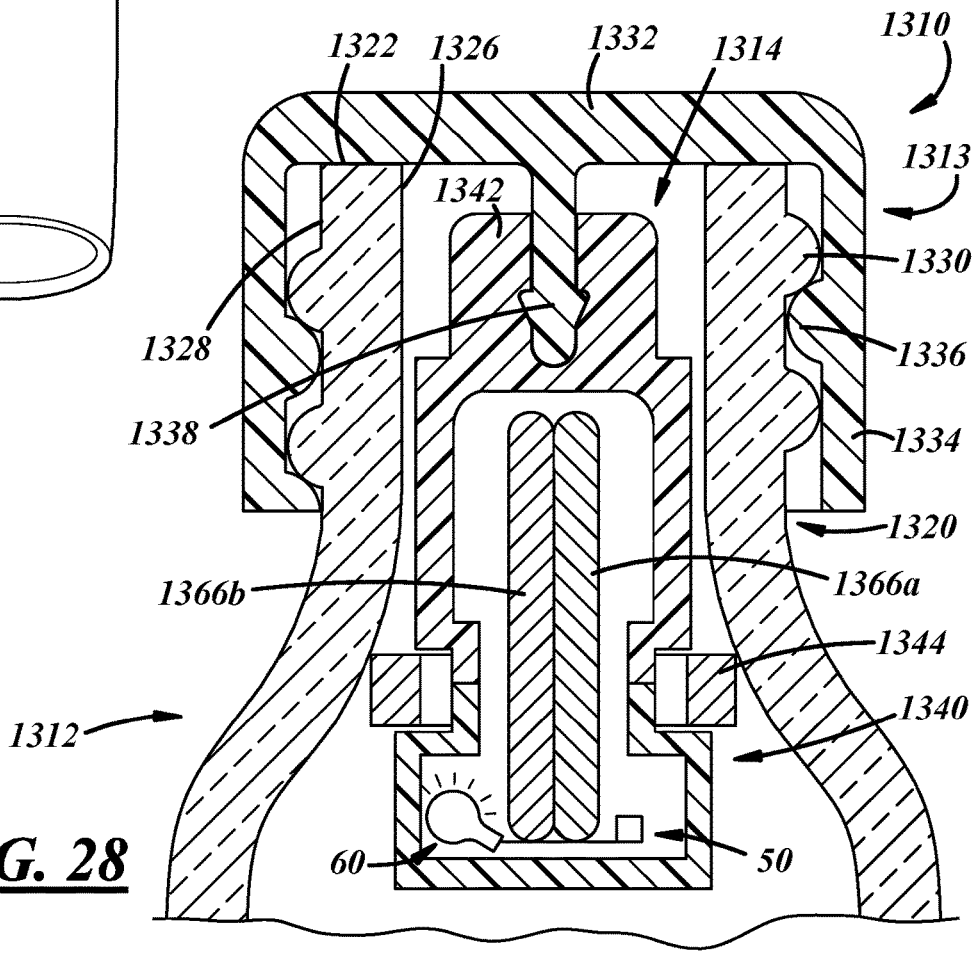
FIG. 28 is a fragmentary, elevational, cross-sectional view of a package according to another illustrative embodiment of the present disclosure, illustrating a container, a closure coupled to the container, and a package opening indicator coupled to the closure and positioned within the container and carrying photosensitive elements.

FIG. 28 illustrates another illustrative embodiment of a package 1310. This embodiment is similar in many respects to the embodiments of FIGS. 1-27 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1310 includes a container 1312, a closure 1313 for the container 1312, and a product filling the container 1312. The package 1310 also may include a drop-style package opening indicator 1314 carried by the container 1312. As will be discussed in further detail below, the indicator 1314 carries multiple photosensitive materials 1366*a*, 1366*b*, for example, a first photosensitive material 1366*a* and a second photosensitive material 1366*b*. The first photosensitive material 1366*a* may be photothermochromic and the second photosensitive material 1366*b* may be photochromic. Also, at least one of the container 1312 or the indicator 1314 carries a UV protector to protect the photosensitive materials 1366*a,b* from exposure to external UV light, for example, before customer use of the package 1310.

The container 1312 may include a neck 1320 including a lip 1322, and an interior surface 1326, a finish which may include an external surface 1328 and one or more threads or thread segments 1330 projecting from the external surface 1328, or the like for coupling to the closure 1313.

The closure 1313 may include a base wall 1332, an annular outer skirt 1334 extending from the base wall 1332 and having one or more internal threads or thread segments 1336 projecting from an internal surface thereof for coupling to the container 1312, and an indicator coupler 1338 extending axially from the base wall 1332 radially inward of the outer skirt 1334. The coupler 1338 may include a bayonet shape to retain the indicator 1314 to the closure 1313 at least in resistance to the weight of the indicator 1314.

The indicator 1314 may include a body 1340, a closure coupling portion 1342 extending from the body 1340 for coupling to the closure coupler 1338, and a resilient member 1344 carried by the body 1340 for non-removable receipt and securement within the container 1312 as previously described above with respect to one or more other embodiments. The closure coupling portion 1342 is illustrated as being detachably coupled to the closure 1313 by a bayonet fit with the bayonet-shaped coupler 1338 of the closure 1313, but may be removably coupled thereto in any other suitable manner. The body 1340 may be of multiple piece construction having portions adhered, welded, or otherwise coupled together to allow assembly around the materials 1366*a,b*, or the body 1340 may be unitary and formed around the materials 1366*a,b*.

In any case, the indicator 1314 may carry the lighting circuit 50 discussed previously above, or any other suitable lighting circuit, and including the light source 60. Detachment of the indicator 1314 from the closure 1313, or proximity of the indicator 1314 to another portion of the container 1312, activates the light source 60, for example, as discussed previously above. In turn, the light emitted from the light source 60 impinges on the photosensitive material 1366*b* so as to darken the photosensitive material 1366*b* to signal to a consumer that the package 1310 has been opened from its original factory sealed condition.

The photosensitive materials may include the first photosensitive material 1366*a* carried in the indicator 1314, and the second photosensitive material 1366*b* carried in the indicator 1314 and different from the first photosensitive material. The first material 1366*a* may be a counterfeit or tamper evident element, and the second material 1366*b* may be a use or opening indicating element.

The first and second materials 1366*a*, 1366*b* may have different activation modes. For example, exposure of the first material 1366*a* to UV light may produce a latent image that is not visible until it is heated to a point at which the first material 1366*a* becomes irreversibly darkened and, thus, visible. The second material 1366*b* may, upon exposure to UV light, darken irreversibly under ordinary conditions, from a UV light source carried by the container or a base therefor, while the first material 1366*a* would remain translucent or transparent. However, if a counterfeiter tampered with the container 1312, for example, by trying to melt a fitment or otherwise heat the container 1312, then the first material 1366*a* would react by irreversibly darkening to provide evidence of such misuse or extraordinary conditions. The first material 1366*a* may include a first metal halide, and the second material 1366*b* may include a second metal halide, which may be different from the first metal halide. The halides may be coatings applied to the elements, or may be part of the composition of the elements themselves.

One or both of the first and second materials 1366*a*, 1366*b* may have a contrast portion, for example, masked and pre-exposed to UV light or covered with a UV protector to create a brand-reinforcing image, for instance, a logo, brand name, slogan, or the like, or latent cautionary indicia, as already described previously above.

Figure 29:
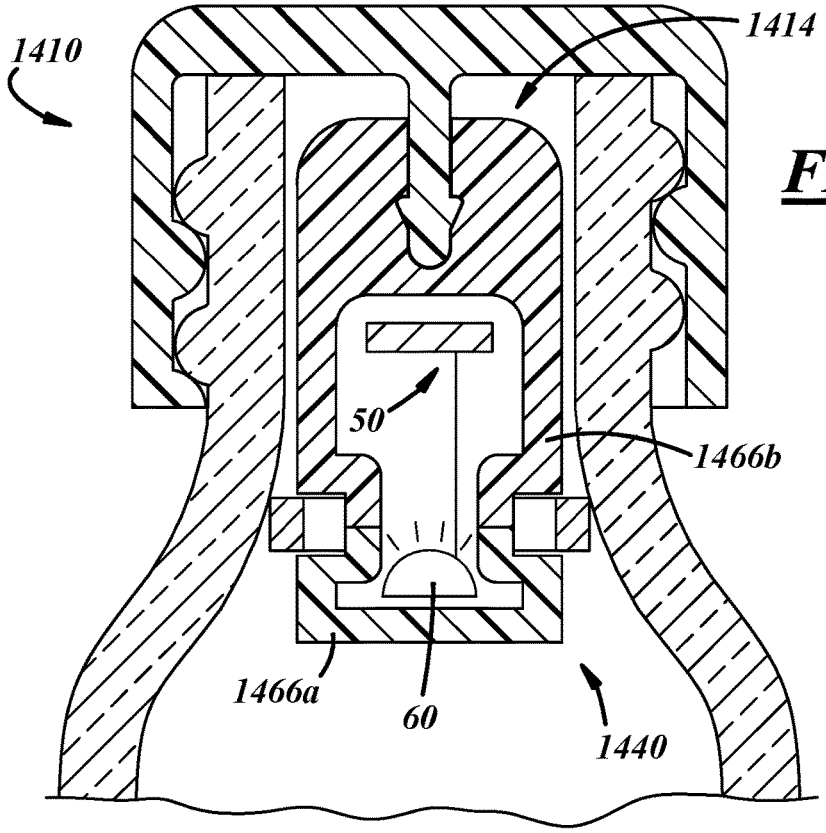
FIG. 29 is a fragmentary, elevational, cross-sectional view of a package according to another illustrative embodiment of the present disclosure, illustrating a container, a closure coupled to the container, and a package opening indicator coupled to the closure and positioned within the container and being constructed of photosensitive portions.

FIG. 29 illustrates another illustrative embodiment of a package 1410. This embodiment is similar in many respects to the embodiments of FIGS. 1-28 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1410 is similar to the package 1310 of FIG. 28, except that an indicator 1414 includes a multi-piece body 1440 constructed of multiple photosensitive materials different from one another. The body 1440 includes a first portion 1466*a*, and a second portion 1466*b* adhered, welded, or otherwise coupled to the first portion 1466*a* and carrying a lighting circuit, for example, the lighting circuit 50 discussed previously above and including the light source 60.

The first and second portions 1466*a*, 1466*b* may be composed of or may carry photosensitive materials having different activation modes. For example, exposure of the first material of the first portion 1466*a* to UV light may produce a latent image that is not visible until it is heated to a point at which the material becomes irreversibly darkened and, thus, visible. The second material of the second portion 1466*b* may, upon exposure to UV light, darken irreversibly under ordinary conditions, from a UV light source carried by the container or a base therefor, while the first material 1466*a* would remain translucent or transparent. The first portion 1466*a* may include a first metal halide material and the second portion 1466*b* may include a second metal halide material different from the first.

One or both of the first and second portions 1466*a*, 1466*b* may have a contrast portion, for example, masked and pre-exposed to UV light or covered with a UV protector to create a brand-reinforcing image, for instance, a logo, brand name, slogan, or the like, or latent cautionary indicia, as already described previously above.

Figure 30:
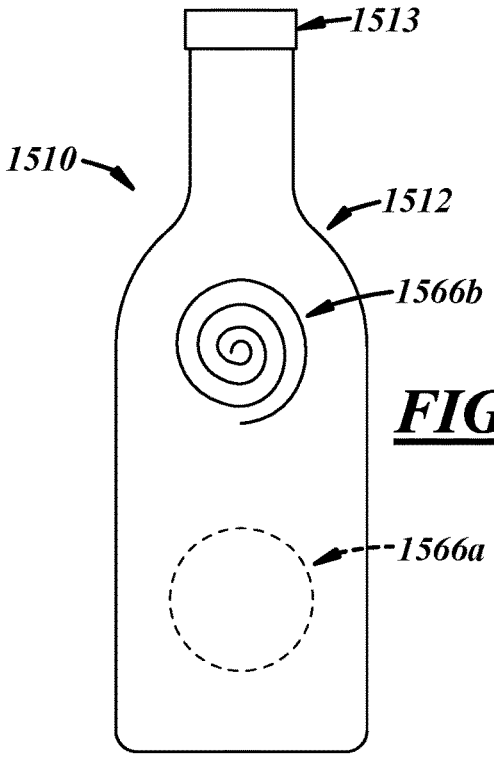
FIG. 30 is an elevational view of a package according to another illustrative embodiment of the present disclosure, illustrating a container, a closure coupled to the container, and photosensitive elements carried by the container.

FIG. 30 illustrates another illustrative embodiment of a package 1510. This embodiment is similar in many respects to the embodiments of FIGS. 1-29 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1510 includes a closure 1513 coupled to a container 1512 and carrying one or more photosensitive materials 1566*a*, 1566*b*. In one embodiment, the photosensitive materials 1566*a,b* may be integral with the container 1512, for instance, internal or external embossments or debossments of the container 1512 itself. In another embodiment, the photosensitive materials 1566*a,b* may be part of separate elements or emblems non-removably secured to an interior surface or an exterior surface of the container 1512 in any suitable manner. In this embodiment, the materials 1566*a*, 1566*b* may be spaced apart from one another in an axial and/or circumferential direction on the container 1512.

The first and second materials 1566*a*, 1566*b* may be composed of or may carry photosensitive materials having different activation modes. For example, exposure of the first material 1566*a* to UV light may produce a latent image that is not visible until the material 1566*a* is heated to a point at which the latent image becomes irreversibly darkened, and thus, is visible to the human eye. The second material 1566*b* may darken irreversibly to produce an image under ordinary conditions, upon exposure of the material 1566*b* to UV light from a UV light source carried by the container or a base therefor, or from ambient UV light that penetrates the UV-unprotected portions of the container. In this case, the first material 1566*a* would remain translucent or transparent until such time as the latent image becomes visible upon heating. The first material 1566*a* may include a first metal halide and the second material 1566*b* may include a second metal halide different from the first.

The first material 1566*a* may have a contrast portion, for example, a portion that is masked and pre-exposed to UV light to create a latent image or a portion that is partially covered with a UV protector whereby a latent image is created upon exposure of the material to UV light and upon subsequent heating of the material, the latent image transforms into an image that is visible to the human eye. The image may include cautionary indicia, as disclosed elsewhere herein.

The second material 1566*b* may have a contrast portion, for example, a portion that is masked and pre-exposed to UV light to create an image or a portion that is partially covered with a UV protector whereby an image is created upon exposure of the material to UV light, for example, upon use of the package. The image may include a brand-reinforcing image, for instance, a logo, brand name, slogan, or the like, or cautionary indicia, or other visible image.

Figure 31:
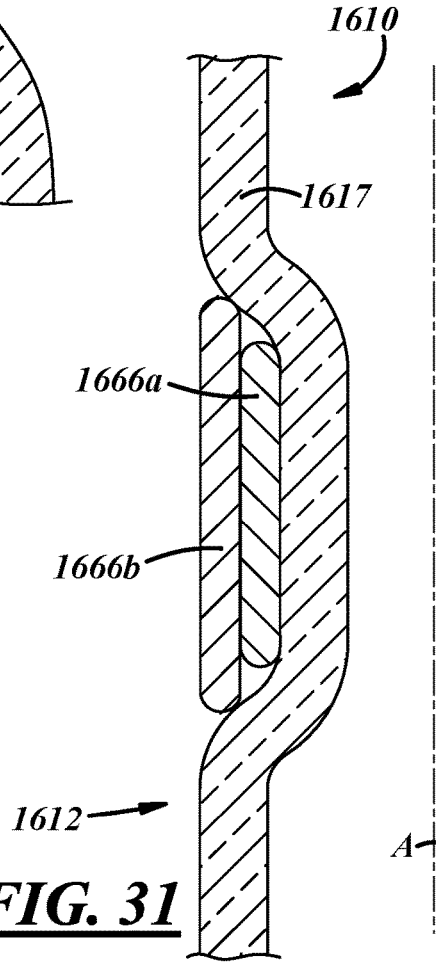
FIG. 31 is a fragmentary, elevational, cross-sectional view of a package according to another illustrative embodiment of the present disclosure, illustrating a container wall carrying photosensitive elements.

FIG. 31 illustrates another illustrative embodiment of a package 1610. This embodiment is similar in many respects to the embodiments of FIGS. 1-30 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1610 includes a container 1612 carrying one or more photosensitive materials 1666*a*, 1666*b*. For example, the container 1612 may include a wall 1617 with a radially inward depression in which the materials 1666*a,b* may be carried. In one embodiment, the photosensitive materials 1666*a,b* may be applied to the container 1612 by ACL or any other suitable application technique(s). In another embodiment, the photosensitive materials 1666*a,b* may be part of separate elements or emblems non-removably carried by the container 1612 in any suitable manner. In this embodiment, the materials 1666*a*, 1666*b* may be disposed on one another in a radial direction on the container 1612 with respect to the axis A.

The first and second materials 1666*a*, 1666*b* may have different activation modes. For example, exposure of the first material 1666*a* to UV light may produce a latent image that is not visible until it is heated to a point at which the material becomes irreversibly darkened and, thus, visible. The second material 1666*b* may, upon exposure to UV light, darken irreversibly under ordinary conditions, from a UV light source carried by the container or a base therefor (or from ambient UV light), while the first material 1666*a* would remain translucent or transparent.

For example, a first one of the materials 1666*a* may include a first metal halide material and may be carried in direct contact with the container wall 1617. Also, a second one of the materials 1666*b* may include a second metal halide, which may be different from the first metal halide, and may be carried in direct contact with and over the first material 1666*a*, and also may contact the container.

One or both of the first and second materials 1666*a*, 1666*b* may have a contrast portion, for example, masked and pre-exposed to UV light or covered with a UV protector to create a brand-reinforcing image, for instance, a logo, brand name, slogan, or the like, or latent cautionary indicia, as already described previously above.

Figure 32:
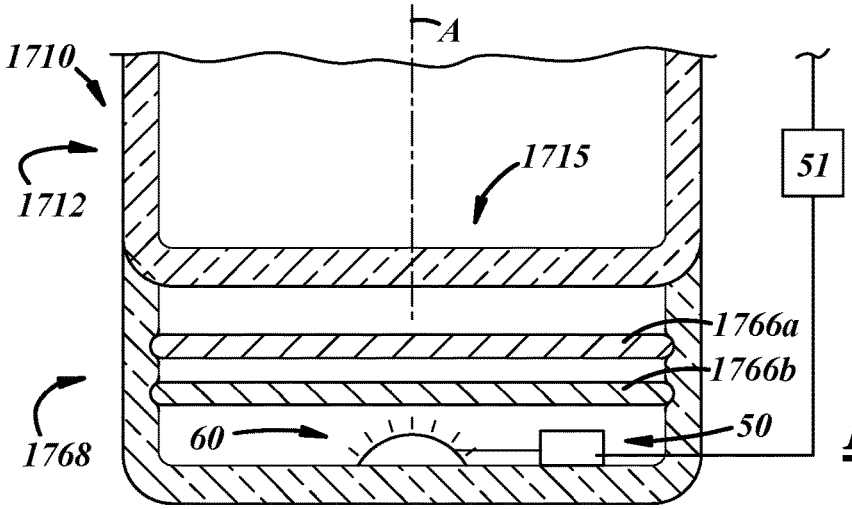
FIG. 32 is a fragmentary, elevational, cross-sectional view of a package according to another illustrative embodiment of the present disclosure, illustrating a container carrying photosensitive elements via a base coupled to the container bottom.

FIG. 32 illustrates another illustrative embodiment of a package 1710. This embodiment is similar in many respects to the embodiments of FIGS. 1-31 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1710 includes a container 1712, a closure (not shown) coupled to the container 1712, a separate container base 1768 coupled to the container 1712, the previously described lighting circuit 50 including the light source 60, any suitable circuitry to indicate package opening, for example, the previously described package opening indicator 51, and multiple photosensitive materials 1766*a,b* carried by the base 1768. The materials 1766*a,b* may be included in or carried by discs, rods, or any other suitably shaped elements that may extend generally transversely with respect to the package axis A. The container 1712 may include its own integral base or closed bottom end 1715 to which the separate base 1768 may be coupled, or may include an open bottom end (not shown) to which the base 1768 may be coupled. In any case, the separate base 1768 may be non-removably coupled to the container 1712, for example, via an epoxy, ceramic adhesive, glass solder or weld, or the like.

The light source 60 may be activated after removal of the closure, for example, as discussed previously above with respect to one or more embodiments. In turn, the light emitted from the light source 60 impinges on the photosensitive material 1766*b* so as to darken the photosensitive material 1766*b* to signal to a consumer that the package 1710 has been opened from its original factory sealed condition.

The photosensitive materials may include a first photosensitive material 1766*a* carried between the base 1768 (and the light source 60) and the bottom 1715 of the container 1712 and, a second photosensitive material 1766*b* carried between the first material 1766*a* and the base 1768 (and the light source 60) and may be different from the first photosensitive material. The first material 1766*a* may be a counterfeit or tamper evident element including a suitable metal halide, and the second material 1766*b* may be a use or opening indicating element including another, different metal halide.

The first and second materials 1766*a*, 1766*b* may be composed of or may carry photosensitive materials having different activation modes. For example, exposure of the first material 1766*a* to UV light may produce a latent image that is not visible until it is heated to a point at which the material becomes irreversibly darkened and, thus, visible. The second material 1766*b* may, upon exposure to UV light, darken irreversibly under ordinary conditions, from a UV light source carried by the container or a base therefor, while the first material 1766*a* would remain translucent or transparent.

One or both of the first and second materials 1766*a*, 1766*b* may have a contrast portion, for example, masked and pre-exposed to UV light or covered with a UV protector to create a brand-reinforcing image, for instance, a logo, brand name, slogan, or the like, or latent cautionary indicia, as already described previously above.

Also, the base 1768 may carry a UV protector, for example, a UV protective coating on an external and/or internal surface of the base 1768, or UV protective material in the material composition of the base 1768 itself. Likewise, the container 1712 may carry a UV protector for example, a UV protective coating on an external and/or internal surface thereof or UV protective material in the material composition thereof.

Figure 33:
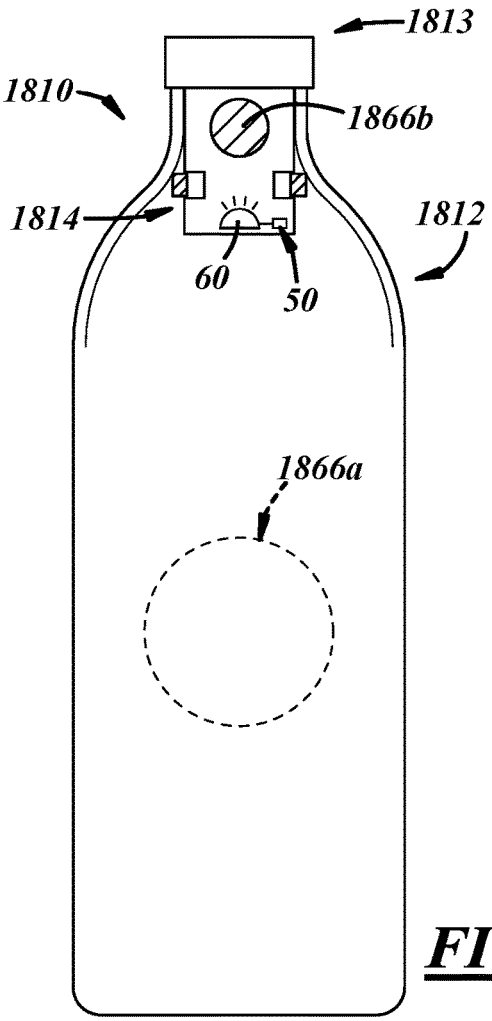
FIGS. 33-34 are elevational views of packages according to other illustrative embodiments of the present disclosure, illustrating containers, closures coupled to the containers, package opening indicators coupled to the closure and positioned within the container, and photosensitive materials carried by walls of the containers.

FIG. 33 illustrates another illustrative embodiment of a package 1810. This embodiment is similar in many respects to the embodiments of FIGS. 1-32 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1810 includes a container 1812, a closure 1813 for the container 1812, and a product (not shown) filling the container 1812. The package 1810 also includes a drop-style package opening indicator 1814 carried by the container 1812, and carrying a lighting circuit, for example, the previously described lighting circuit 50 and light source 60.

The container 1812 carries multiple photosensitive materials. For example, a first photosensitive material 1866*a* may be carried on an interior or exterior surface of the container 1812. In another example, the container 1812 carries a second photosensitive material 1866*b*, via the indicator 1814. The first and second materials 1866*a*, 1866*b* may be composed of or may carry photosensitive materials having different activation modes. For example, exposure of the first material 1866*a* to UV light may produce a latent image that is not visible until it is heated to a point at which the material becomes irreversibly darkened and, thus, visible. The second material 1866*b* may, upon exposure to UV light, darken irreversibly under ordinary conditions, from a UV light source carried by the container or a base therefor, while the first material 1866*a* would remain translucent or transparent.

One or both of the first and second materials 1866*a*, 1866*b* may have a contrast portion, for example, masked and pre-exposed to UV light or covered with a UV protector to create a brand-reinforcing image, for instance, a logo, brand name, slogan, or the like, or latent cautionary indicia, as already described previously above.

Also, at least one of the container 1812 or the indicator 1814 carries a UV protector to protect one or both of the photosensitive materials 1866*a,b* from exposure to external UV light, for example, before initial opening of the package 1810. In this embodiment, the first photosensitive material 1866*a* may include a separate element composed of or coated with a first photosensitive material.

Figure 34:
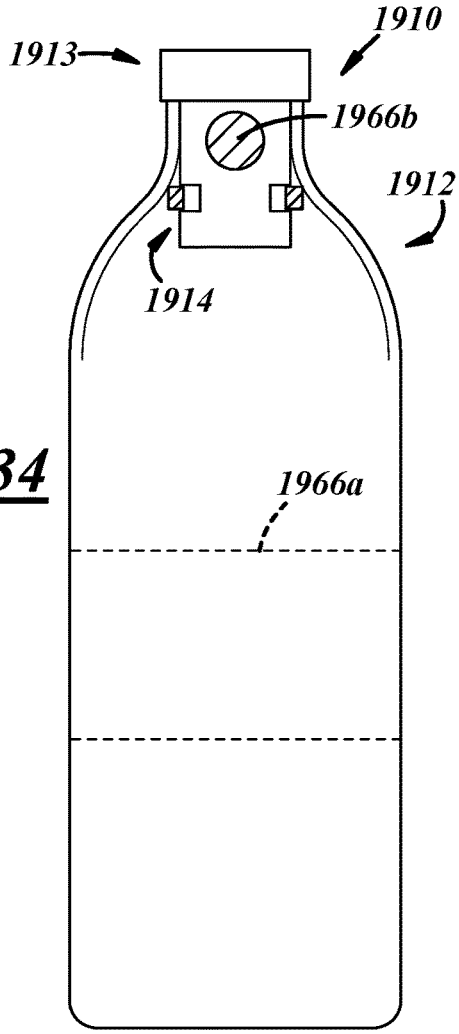

FIG. 34 illustrates another illustrative embodiment of a package 1910. This embodiment is similar in many respects to the embodiments of FIGS. 1-33 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 1910 includes a container 1912 and closure 1913 coupled thereto, and is largely similar to the package 1810 of FIG. 33. But in this embodiment, the container 1912 includes a first photosensitive material 1966*a* in the form of a sintered layer of material that may be produced and applied as already described above with respect to one or more other embodiments. A second photosensitive material 1966*b* may be carried by a drop indicator 1914 in any suitable manner.

The first and second materials 1966*a*, 1966*b* may be composed of or may carry photosensitive materials having different activation modes. For example, exposure of the first material 1966*a* to UV light may produce a latent image that is not visible until it is heated to a point at which the material becomes irreversibly darkened and, thus, visible. The second material 1966*b* may, upon exposure to UV light, darken irreversibly under ordinary conditions, from a UV light source carried by the container or a base therefor, while the first material 1966*a* would remain translucent or transparent.

One or both of the first and second materials 1966*a*, 1966*b* may have a contrast portion, for example, masked and pre-exposed to UV light or covered with a UV protector to create a brand-reinforcing image, for instance, a logo, brand name, slogan, or the like, or latent cautionary indicia, as already described previously above.

According to other embodiments of the present disclosure, there are provided methods of producing and using a package. The method of producing a package includes applying a photosensitive material to a container that is responsive to ultraviolet (UV) light so as to darken upon exposure thereto, protecting at least a portion of the photosensitive material from exposure to UV light before initial opening of the package, filling the container with an original flowable product, and applying a closure to the container. The method also may include coupling a package opening indicator to the closure before the closure is applied to the container, wherein the indicator is detachable from the closure upon removal of the closure from the container. The applying step may include at least one of coating one or more surfaces of the container with a photosensitive material or composing at least a portion of the container of the photosensitive material. The protecting step may include at least one of coating one or more surfaces of the container with a UV protectant material or composing at least a portion of the container of the UV protectant material. The protecting step may include applying an appliqué to an exterior surface of the container that includes a UV protectant material, and further may include coupling the appliqué to the closure so that removal of the closure causes removal of the appliqué.

The method of using the package produced by the method above may include removing the closure from the container and dispensing the flowable product out of the container, wherein at least a portion of the photosensitive material is exposed to UV light upon removal of the closure.

There thus has been disclosed a container, a product, a package, and a method that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A method of producing a food or beverage container that includes:

applying a photochromic material to a food or beverage container that is responsive to ultraviolet (UV) light so as to darken upon exposure thereto; and protecting at least a portion of the photochromic material from exposure to UV light, wherein the protecting step includes at least one of: coating one or more interior surfaces of the container with a UV protectant material, composing at least a portion of the container of the UV protectant material, or wherein the method further comprises a filling step that includes filling the container with an original flowable product which includes a UV absorbing product.

2. A method of producing a food or beverage container that includes:

applying a photochromic material to a food or beverage container that is responsive to ultraviolet (UV) light so as to darken upon exposure thereto; and protecting at least a portion of the photochromic material from exposure to UV light, wherein the protecting step includes at least one of: coating one or more interior surfaces of the container with a UV protectant material, composing at least a portion of the container of the UV protectant material, or wherein the method further comprises a filling step that includes filling the container with an original flowable product which includes a UV absorbing product, filling the container with the original flowable product; and applying a closure to the container.

3. A method of producing a food or beverage container that includes:

applying a photochromic material to a drop indicator of the food or beverage container that is responsive to ultraviolet (UV) light so as to darken upon exposure thereto; and protecting at least a portion of the photochromic material from exposure to UV light, coupling said drop indicator to a closure of the container for separation from said closure when said closure is removed from said container such that said drop indicator drops into said container and said photochromic material changes appearance upon exposure to UV light; and activating an ultraviolet light source for exposing said drop indicator, wherein said ultraviolet light source is carried by said drop indicator.

4. A method of producing a food or beverage container that includes:

applying a photochromic material to a drop indicator of the food or beverage container that is responsive to ultraviolet (UV) light so as to darken upon exposure thereto;

protecting at least a portion of the photochromic material from exposure to UV light, wherein the protecting step includes at least one of: coating one or more interior surfaces of the container with a UV protectant material, composing at least a portion of the container of the UV protectant material, or wherein the method further comprises a filling step that includes filling the container with an original flowable product which includes a UV absorbing product; and coupling said drop indicator to a closure of the container for separation from said closure when said closure is removed from said container such that said drop indicator drops into said container and said photochromic material changes appearance upon exposure to UV light.

5. The method set forth in claim 4 wherein the drop indicator carries a UV protector.

6. The method set forth in claim 4 wherein the applying step comprises integrating the photochromic material into the composition of the drop indicator itself.

7. The method set forth in claim 4 further comprising activating an ultraviolet light source for exposing said drop indicator.

* * * * *